US008777218B2

(12) United States Patent
Nemoto

(10) Patent No.: US 8,777,218 B2
(45) Date of Patent: Jul. 15, 2014

(54) MEDIA PROCESSOR

(75) Inventor: Yukihiro Nemoto, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 210 days.

(21) Appl. No.: 12/737,801

(22) PCT Filed: Jun. 22, 2009

(86) PCT No.: PCT/JP2009/061294

§ 371 (c)(1),
(2), (4) Date: Feb. 17, 2011

(87) PCT Pub. No.: WO2010/021198

PCT Pub. Date: Feb. 25, 2010

(65) Prior Publication Data

US 2011/0133389 A1 Jun. 9, 2011

(30) Foreign Application Priority Data

Aug. 18, 2008 (JP) ..... 2008-210101

(51) Int. Cl.
*B65H 29/66* (2006.01)

(52) U.S. Cl.
USPC ..... 271/216; 271/209; 271/3.01

(58) Field of Classification Search
USPC ..... 271/3.01, 209, 216; 902/12; 194/223, 194/225, 228
See application file for complete search history.

(56) References Cited

U.S. PATENT DOCUMENTS

| | | | | |
|---|---|---|---|---|
| 5,016,867 | A * | 5/1991 | Kamath | 271/209 |
| 6,942,207 | B2 * | 9/2005 | Katou et al. | 271/3.01 |
| 7,243,914 | B2 | 7/2007 | Tokunaga et al. | |
| 2004/0135304 | A1 * | 7/2004 | Tokunaga et al. | 271/3.01 |

FOREIGN PATENT DOCUMENTS

| | | | |
|---|---|---|---|
| JP | 57-004853 | | 1/1982 |
| JP | 58-144048 | | 8/1983 |
| JP | 61-183050 | | 8/1986 |
| JP | 04-066784 | A | 10/1992 |
| JP | 2000-048234 | A | 2/2000 |
| JP | 2008-081292 | A | 4/2008 |
| KR | 10-2004-0034435 | | 4/2004 |

OTHER PUBLICATIONS

Foreign Office Action issued on Aug. 19, 2013.
Foreign Office Action issued on Feb. 25, 2014 with English translation.

* cited by examiner

*Primary Examiner* — Michael McCullough
*Assistant Examiner* — Howard Sanders
(74) *Attorney, Agent, or Firm* — Rabin & Berdo, P.C.

(57) ABSTRACT

A media processor is provided with includes a conveyance channel over which a paper sheet-like medium is conveyed, and an accumulation mechanism which accumulates the medium sent from the conveyance channel, the accumulation mechanism including a guide member for guiding and accumulating the medium sent from the conveyance channel and a conveyor for catching the medium guided by the guide member against the guide member to draw the medium onto the guide member. It is thus possible to shorten times required for the preparing operation to accumulate bills and for the bill accumulating operation, and further to prevent mechanical malfunction such as bill jamming from occurring.

17 Claims, 29 Drawing Sheets

MEDIA PROCESSOR

TECHNICAL FIELD

The present invention relates to a media processor, and, in more particular, to a paper sheet processor which accumulates and stores paper sheet-like media such as bills or separates lumped paper sheets from each other and executes a variety of other processing on paper sheets.

BACKGROUND ART

Conventionally, on a variety of uses put are paper sheet processors which draw a single or plural paper sheets such as bills, when put into the inlet slot, into the processor, and separate the paper sheets from each other by use of the separator mechanism, provided inside the processor for separating bills, to deliver and accumulate the paper sheets into the temporary holder and storage.

Paper sheet processors usually have various bill processing units provided therein, such as a gateway which receives bills from the outside of the paper sheet processor and from which the bills are discharged, a storage which stores bills to be paid out, and so on.

With the conventional paper sheet processors, each bill processing unit is provided with a bill accumulation mechanism having an accumulation plate, which is lifted or lowered each time a bill is conveyed into the processing unit, to successively accumulate conveyed bills on the pressing plate.

Further, as the paper sheet storage mechanism described in Japanese patent laid-open publication No. 2000-48234, there is an apparatus as well in which the leading ends of bills are adapted to knock a stopper in the storage without using an accumulation plate, and the rear ends of the bills are slapped by the sheet rollers to accumulate the bills.

However, if an accumulation plate is provided in the conventional apparatus, the accumulation plate would operatively be lifted and lowered each time a bill is accumulated, thus problematically taking a long time for accumulating the bills.

In the meanwhile, in the conventional art without using an accumulation plate, there is a problem that a bill released to an accumulation mechanism may knock the pressing plate or bills accumulated on the pressing plate, thus leading to easily causing mechanical malfunction such as bill jamming.

SUMMARY OF THE INVENTION

In view of those problems, it is an object of the present invention to provide a media processor which accumulates bills in a short time without causing mechanical malfunction such as bill jamming.

In accordance with the present invention, the media processor includes a conveyance channel over which a paper sheet-like medium is conveyed and an accumulation mechanism that accumulates the medium sent from the conveyance channel. The accumulation mechanism includes a guide member that guides and accumulates the medium sent from the conveyance channel, and a conveyor that catches the medium guided by the guide member against the guide member and draws the medium onto the guide member.

In accordance with the present invention, since sheet-like media are caught between the conveyor and the guide member to be accumulated, it is possible to shorten a time required for preparing to accumulate bills, thus making it possible to shorten a time for accumulating, bills.

Further, in accordance with the present invention, since sheet-like media are caught between the conveyor and the guide member to be drawn onto the guide member, it is possible to prevent mechanical malfunction such as bill jamming from being caused.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Next, an embodiment of a media processor according to the present invention will be described in detail with reference to the accompanying drawings. In addition, the term, paper sheets, means all kinds of paper sheet-like media such as bills, railway tickets, airline tickets, gift certificates and admission tickets. However, the following embodiment will be described as directed to paper sheets being bills. Accordingly, in the following description, although the apparatus according to the present invention will be expressed as a bill processor, the present invention is applicable to an apparatus for processing all kinds of paper sheet-like media.

Figure 1:
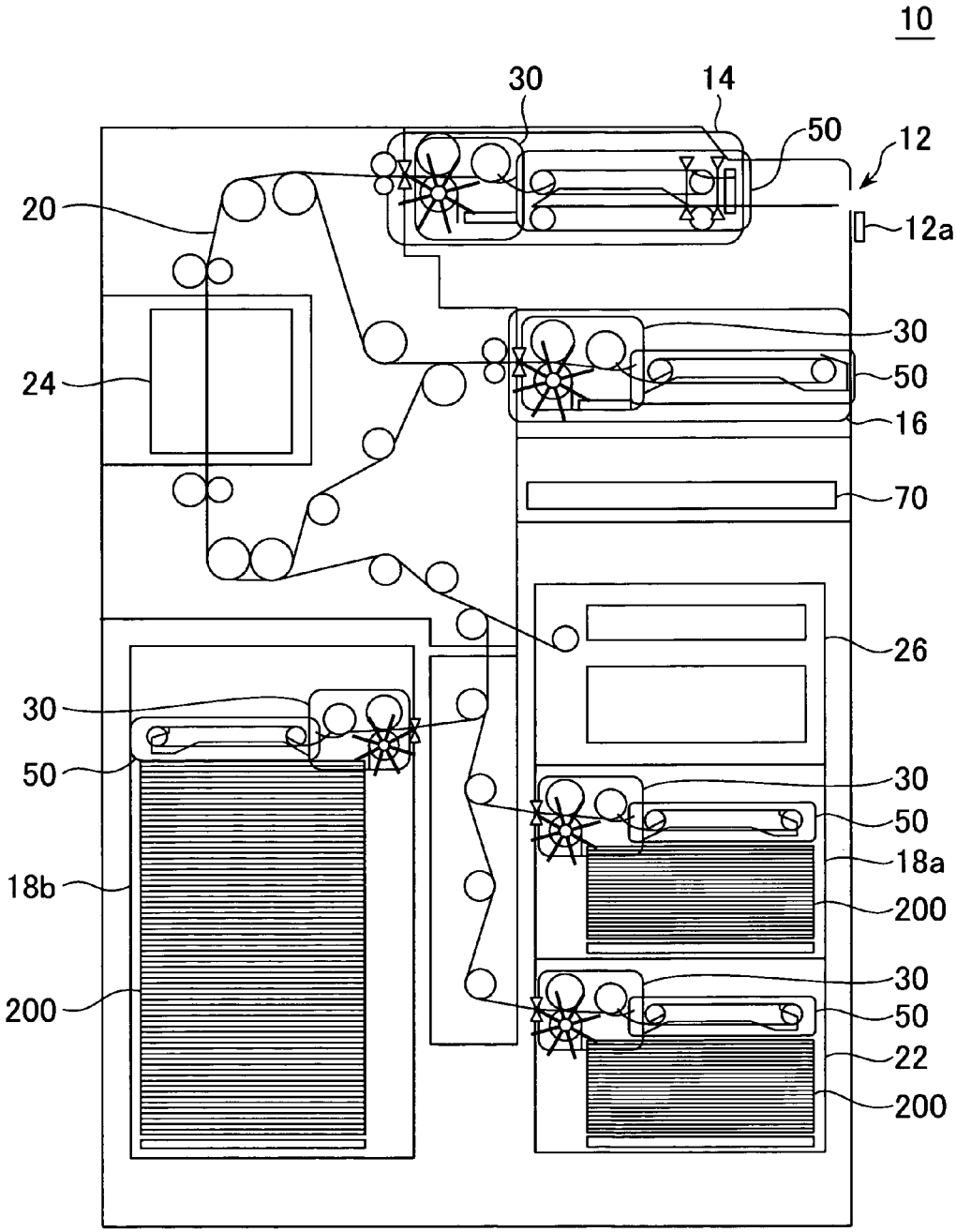
FIG. 1 shows the overall configuration of an embodiment of a paper sheet processor according to the present invention.

FIG. 1 shows a bill processor 10 according to the present embodiment which is configured to convey bills put into a customer interface 12 to the processing units for processing bills such as a gateway 14, a temporary holder 16 and a storage 18, which are provided in the processor 10, and accumulate (for example, deposit) the bills in an appropriate processing unit. The bill processor 10 is further configured to separate the bills accumulated in the processing units from each other to convey (for example, refund deposited bills and pay) the bills to the customer interface 12.

The customer interface 12 is a processing unit, which is provided so as to partially be exposed on the external surface of the bill processor 10, and functions to perform reception and delivery of bills for the user. The customer interface 12 has an opening part formed through which the outside and inside of the processor 10 communicate with each other to receive and discharge bills. The customer interface 12 is preferably provided with a shutter 12*a* for opening and closing the opening part by a driving machine such as a motor, not shown.

The gateway 14 is a processing unit communicating with the customer interface 12, which accepts a single or plural bills in lump inserted from the outside of the bill processor 10 through the customer interface 12 to transfer the received bills to other processing units. The gateway 14 is also adapted to discharge a single or plural bills, received from other processing units and accumulated, in lump to the customer interface 12.

The gateway 14 has its other end connected to a conveyance channel 20 composed of rollers, belts and the like for catching bills to convey the bills. The conveyance channel 20 is composed of the rollers, belts and the like for catching bills to convey them, and connects the processing units for processing bills such as the gateway 14, temporary holder 16, and storages 18*a* and 18*b* with each other. Further, at branching points of the conveyance section 20, switching blades, not shown, are provided which are capable of appropriately switching a conveying direction of bills. It is thus possible to appropriately deliver bills between those processing units.

The temporary holder 16 is a mechanism that temporarily reserves bills inserted from the outside of the processor 10 until the bills are permitted to be stored in the storage suitable for the bills. The temporary holder 16 is connected via the conveyance channel 20 to the gateway 14, the storage 18 and the like.

The storage 18 is adapted to store bills to be paid out, and has two storage 18*a* and 18*b* in the present embodiment. FIG. 1 shows a situation in which bills 200 are stored in the storage 18*a* and 18*b*. The storage 18 is capable of storing as well such ones of the bills put into the gateway 14 which are discriminated as bills suitable to be paid out by a discriminator, which will be described later.

Moreover, the bill processor 10 may be further provided with a feeder/retriever 22 which is connected by the conveyance channel 20 to the processing units such as the gateway 14, and the storages 18*a* and 18*b*. The feeder/retriever 22 as well is a sort of processing unit for processing bills, and is applicable to a variety of uses according to circumstances such that bills are stored in advance for supplementarily being fed in case where bills in the storage 18 run short, or that bills to be retrieved as not to be paid out are retrieved from the storage 18, for example. The configuration of the feeder/retriever 22 may be the same as the storage 18.

It is more preferable that the bill processor 10 includes a discriminator 24 for discriminating the authenticity, types, number, appropriateness for paying-out and so on of bills to be conveyed. The discriminator 24 communicates with the gateway 14, the temporary holder 16, the storage 18, the feeder/retriever 22, and a reject storage unit 26, which will be next described, by the conveyance channel 20.

The reject storage unit 26 is adapted for storing bills unsuitable to be paid out, and is connected by the conveyance channel 20 to the gateway 14, the temporary holder 16, the storage 18 and the discriminator 24. Accordingly, bills determined unsuitable to be paid by the discriminator 24 will be stored in the reject storage unit 26 through the conveyance channel 20.

The gateway 14, the temporary holder 16, the storage 18 and the feeder/retriever 22 may be provided with separation mechanisms 30 for separating accumulated bills from each other to send the bills in series to the conveyance unit 20, and with accumulation mechanisms 50 for accumulating the bills conveyed over the conveyance unit 20. The configurations and operations of the separation mechanisms 30 and the accumulation mechanisms 50 will be described later in detail.

Further, the bill processor 10 includes a controller for controlling the entire processor 10 in response to control programs stored in a memory, not shown. As an example of the controller 70, a CPU (Central Processing Unit) or the like may be applied.

Figure 2:
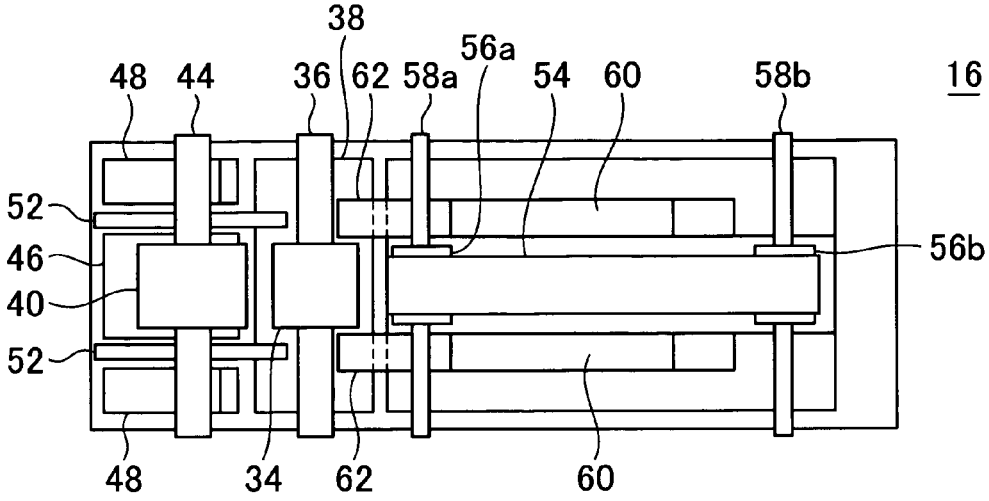
FIG. 2 shows in a top view the essential portion of the temporary holder shown in FIG. 1.
Figure 3:
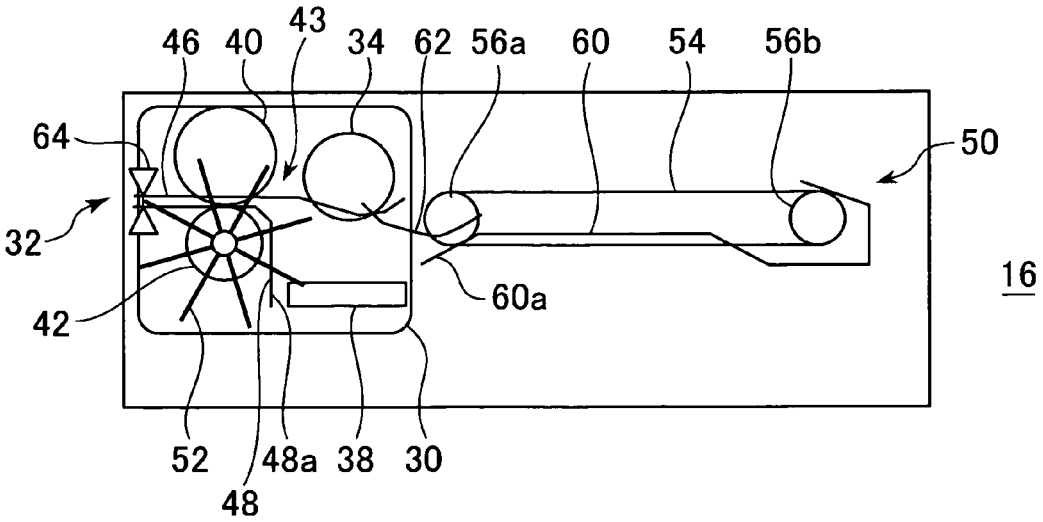
FIG. 3 shows in a side view the essential portion of the temporary holder shown in FIG. 1.

Next, the configurations and operations of the respective processing units in which the separation mechanisms and the accumulation mechanisms 50 are provided will be described in detail. For convenience of illustration, first, the temporary holder 16 will be described with reference to FIGS. 2 and 3. In addition, FIG. 2 is a top view of the essential portion and FIG. 3 is a side view of the essential portion with some of the components thereof daringly omitted for convenience of understanding of the invention. This is also the case with the figures showing the remaining processing units.

First, the configuration of the separation mechanism will be described. In the temporary holder 16, the separation mechanism 30 is arranged between the accumulation mechanism 50 and a bill delivery slot 32 connected to the conveyance channel 20 shown in FIG. 1. The separation mechanism 30 has a pickup roller 34 arranged near the connecting point with the accumulation mechanism 50 for feeding out bills accumulated by the accumulation mechanism 50 to the outside of the temporary holder 16.

Figure 4:
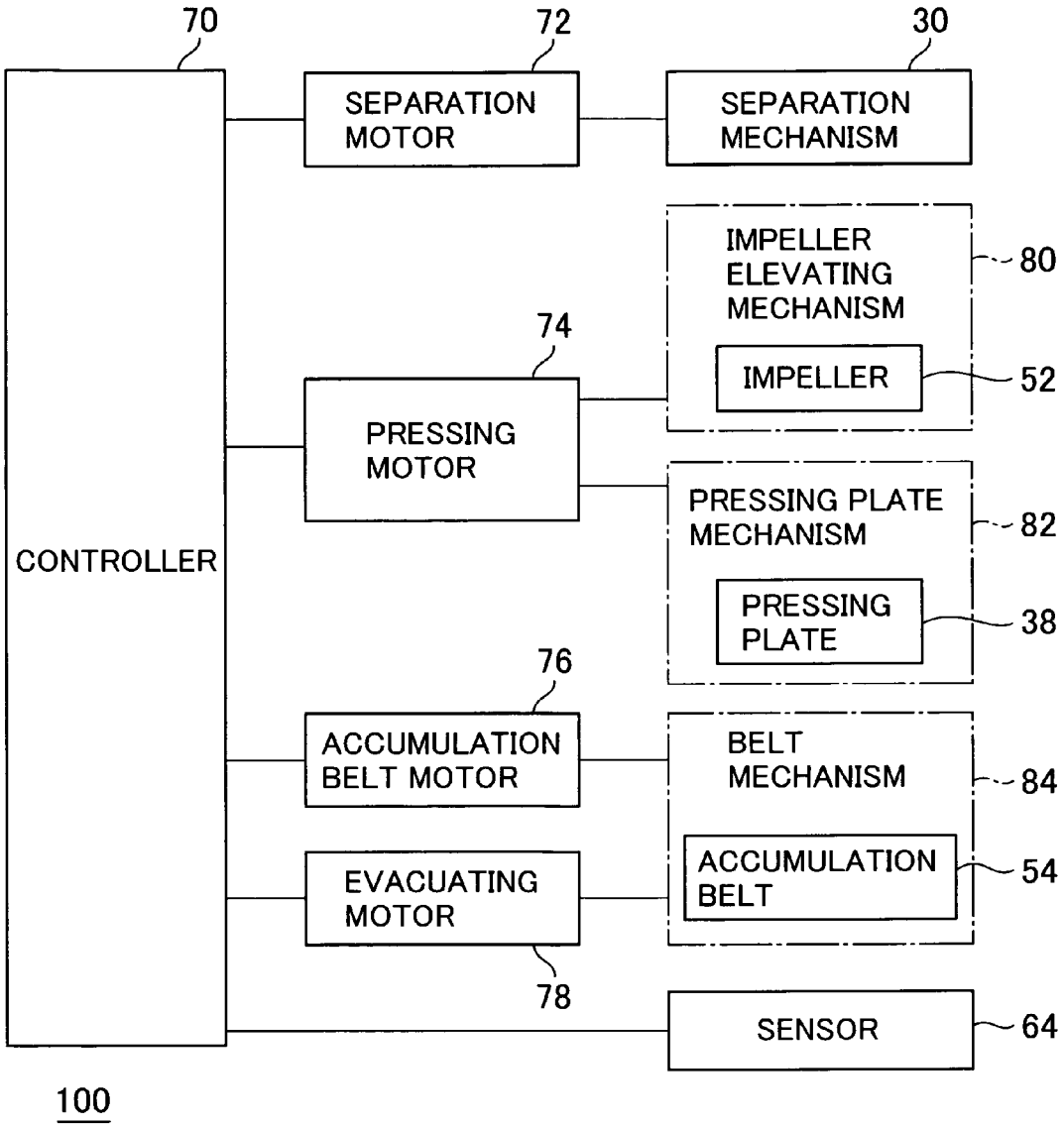
FIG. 4 is a block diagram showing the configuration of a control system of the temporary holder shown in FIG. 1.

Into an insertion hole placed so as to pass through the central parts of circular planes on both side surfaces of the pickup roller 34, inserted is a shaft 36 to be rotated by a driving machine such as a separation motor 72, not shown in FIGS. 2 and 3. The configurational relationship in control aspect between the separation motor 72 and the separation mechanism 30 will be described later in detail, and is shown in FIG. 4.

The pickup roller 34 is equipped with a high-frictional material such as rubber for obtaining appropriate frictional force against a bill on a part of its circumferential surface. The circumferential surface other than the high-frictional material has a low friction. Accordingly, when the pickup roller 34 is rotated in the clockwise direction in FIG. 3, it is possible to send out a bill pressed against the high-frictional material in the direction of the bill delivery slot 32.

In the separation mechanism 30, a pressing plate 38 for pressing accumulated bills against the pickup roller 34 is disposed so as to face the lower side of the pickup roller 34. The pressing plate 38 is configured to operate to be lifted and lowered by a driving machine such as a pressing motor 74 and a pressing plate mechanism 82 for lifting and lowering the pressing plate 38, the driving machine and the pressing plate mechanism 82 not being shown in FIGS. 2 and 3. In the context, the pressing plate mechanism 82 means parts and members provided for receiving the driving force of the motor 74 to lift and lower the pressing plate 38. The pressing plate 38 as well is included therein as its element. By lifting the pressing plate 38, it is possible to press bills against the pickup roller 34 accumulated above the pressing plate 38. The configurational relationship in control aspect between the pressing plate 38, the pressing plate mechanism 82 and the pressing motor 74 will be described later in detail, and is shown in FIG. 4.

In the separation mechanism 30, a feed roller 40 and a gate roller 42 are installed so as to face each other in the direction of the bill delivery slot 32 from the pickup roller 34. The feed roller 40 and the gate roller 42 are arranged so as to mesh with each other on their circumferences and face each other above and below near the exit of the separation mechanism 30, i.e. near the bill delivery slot 32, and its meshing portion is served as a separating gate 43 for bills. With reference to FIG. 3, the one installed above the separating gate 43 is the feed roller 40, and the other installed below the separating gate 43 is the gate roller 42.

The feed roller 40 has a high-frictional material such as rubber for attaining appropriate frictional force against a bill on a part of its circumferential surface in the same way as the pickup roller 34. The circumferential surface other than the high-frictional material has a low friction. Then, the high-frictional portions of the pickup roller 34 and the feed roller 40 rotate synchronously with each other.

Into an insertion hole provided so as to pass through the central parts of circular planes on both side surfaces of the feed roller 40, inserted is a shaft 44 rotatable by the driving machine such as the separation motor 72, not shown in FIGS. 2 and 3. Although not illustrated, a shaft rotatable by the driving machine such as the separation motor 72 is inserted into the gate roller 42 as well in the same way.

When the feed roller 40 is rotated in the same direction as the pickup roller 34, i.e. in the clockwise direction in FIG. 3, and on the contrary, when the gate roller is rotated in a direction opposite to that of the feed roller 40, i.e. in the counterclockwise direction in FIG. 3, it is possible to separate the bills sent from the pickup roller 34 from each other to send out the bills to the bill delivery slot 32. In the meanwhile, by rotating the feed roller 40 and the gate roller 42 in the respective directions opposite to the above-described directions, it is possible to draw the bills from the bill delivery slot 32.

The separation mechanism 30 has sheet guides 46 and 48 for guiding a bill sent out from the separating gate 43 to the bill delivery slot 32. The sheet guide 46 is arbitrary in shape, position and the like as long as it is arranged so as to regulate the upper side of a bill. The sheet guide 48 may be arbitrary in shape, position and the like as long as it is arranged so as to regulate the lower side of a bill.

In the present embodiment, the sheet guide 46 regulating the upper side of a bill is arranged so as to extend to the pickup roller 34 from the bill delivery slot 32 via the feed roller 40. The sheet guide 48 regulating the lower side of a bill is arranged so as to face the lower side of the sheet guide 46 near the bill delivery slot 32 and the feed roller 40. However, the sheet guide 48 does not directly extend to the pickup roller 34, but approximately downward in the vertical direction from around the portion passing by the separating gate 43 composed of the feed roller 40 and the gate roller 42. That is, the sheet guide 48 partly composes a wall 48*a*. As a result of taking this configuration, a bill sent from the accumulation mechanism 50 will strike against the wall 48*a*, so that it is possible to align the leading ends of bills.

Under this configuration, the separation mechanism 30 is capable of separating the accumulated bills from each other to send out the bills to the outside of the temporary holder 16.

Next, the configuration of the accumulation mechanism will be described. The accumulation mechanism 50 has impellers 52 which are initially positioned sidewise on the opposite sides of the gate roller 42. The impeller 52 has a rotary shaft, and tongue-like members made of a soft material such as rubber having flexibility are radially provided about the rotary shaft. The rotary shaft of the impeller 52 rotates in a direction in which bills are sent from the outside of the temporary holder 16 by the driving machine such as the separation motor 72, not shown in FIGS. 2 and 3, i.e. in the clockwise direction in FIG. 3. The rear end of a bill sent from the outside of the temporary holder 16 will be slapped down by this rotation. The rear end of the bill slapped down by the impellers 52 will be received on the pressing plate 38.

Further, the impellers 52 are capable of freely operating to be lifted and lowered by the driving machine such as the pressing motor 74, not shown in FIGS. 2 and 3, and by an impeller elevating mechanism 80 for lifting and lowering the impellers 52. That is, it is possible to lower the impellers from the state where they are disposed sidewise on the opposite sides of the gate roller 42 shown in FIG. 3. In the context, the impeller elevating mechanism 22 means parts and members provided for receiving the driving force of the pressing motor 74 to lift and lower the impellers 52, and includes the impellers 52 as well therein as its elements. The configurational relationship in control aspect between the impellers 52, the impeller elevating mechanism 80 and the pressing motor 74 will be described later in detail, and is shown in FIG. 4.

The accumulation mechanism 50 has an accumulation belt 54 and pulleys 56*a* and 56*b* serving as a sort of bill conveyor. The accumulation belt 54 is an endless belt formed of an elastic material such as rubber, and bridges the pulleys 56*a* and 56*b*. The pulleys 56*a* and 56*b* may be considered as components of a belt mechanism 84, not shown in FIGS. 2 and 3, for rotating the accumulation belt 54. The pulleys 56*a* and 56*b* have shafts 58*a* and 58*b* respectively inserted to be rotated by a driving machine such as an accumulation belt motor 76, not shown in FIGS. 2 and 3. The accumulation belt 54 is rotated as well in response to the rotational operation of the shafts 58*a* and 58*b*. The configurational relationship in control aspect between the accumulation belt 54, the belt mechanism 84 and the accumulation belt motor 76 will be described later in detail, and is shown in FIG. 4.

The accumulation belt 54 is arranged so as to touch the central part in the conveying direction of bills sent from the outside of the temporary holder 16, and capable of conveying a bill touching the belt during the rotational movement in the direction of force applied to the touching part.

Further, the accumulation belt 54 is configured to be capable of being lifted and lowered by a driving machine such as an evacuating motor 78 and the belt mechanism 84 serving as a mechanism for lifting and lowering the accumulation belt 54, the driving machine and the belt mechanism 84 not being shown in FIGS. 2 and 3. This configuration is taken, in order not to interfere with a separating work due to the accumulation belt otherwise touching separating bills at the time of separating the bills in the temporary holder 16, for the purpose of evacuating the accumulation belt 54 to a position at which there is no risk of touching the bills. The configurational relationship in control aspect between the accumulation belt 54, the belt mechanism 84 and the evacuating motor 78 will be described later in detail, and is shown in FIG. 4.

The accumulation mechanism 50 has sheet guides 60 serving as guide members. The sheet guides 60 are disposed so as to face the respective opposite sides of the accumulation belt 54 in the vicinity thereof. The sheet guides 60 are provided for guiding the bill to an appropriate accumulating position by catching a bill sent from the separation mechanism against the accumulation belt 54. Accordingly, specific dispositions of the sheet guides 60 may be arbitrarily selected as long as it is possible to catch a bill between the sheet guides 60 and the accumulation belt 54. Further, the shape of the sheet guides 60 may be freely designed as long as it is possible to smoothly guide a bill.

The sheet guides 60 have the tip portions thereof, one of which faces the separation mechanism 30 to form a receiver 60*a* inclined downward so as to smoothly guide a bill sent from the separation mechanism 30 to between the sheet guides 60 and the accumulation belt 54.

In accordance with the above configuration, when the accumulation belt is rotated in the counterclockwise direction shown in FIG. 3, a bill guided by the receivers 60*a* and drawn by the accumulation belt 54 is caught between the belt 54 and the sheet guides 60, and is conveyed by the accumulation belt 54 to be piled up on the sheet guides 60.

The accumulation mechanism 50 has sheet guides 62. The sheet guides 62 are members, which are provided to extend sidewise between the pickup roller 34 and the accumulation belt 54 for smoothly guiding a bill to be sent from the conveyance channel 20 through the separation mechanism 30 to between the accumulation belt 54 and the sheet guides 60. The accumulation mechanism 50 is configured to be further capable of accumulating bills, sent from the outside of the temporary holder 16 through the separation mechanism 30, on the sheet guides 60.

Moreover, the accumulation mechanism 50 has a sensor 64. The sensor 64 is disposed near the bill delivery slot 32 to sense the rear end of a bill sent from the outside of the temporary holder 16. Thus, the sensor 64 senses that the bill is appropriately sent into the temporary holder 16.

Next, the configuration of the control system associated with the temporary holder 16 will be described with reference to FIG. 4. The controller 70, with which the bill processor 10 is equipped, is operative in response to control programs, or software, stored in the memory, not shown, to control the entire temporary holder 16 by means of the driving machines such as the separation motor 72, the pressing motor 74, the accumulation belt motor 76 and the evacuating motor 78, as well as the sensor 64. More specifically, the separation motor 72, the pressing motor 74, the accumulation belt motor 76 and the evacuating motor 78 are operatively connected to various kinds of mechanisms such as the separation mechanism 30 for separating lumped bills, the impeller elevating mechanism 80 for lifting and lowering the impellers 52, the pressing plate mechanism 82 for lifting and lowering the pressing plate 38, and the belt mechanism 84 for rotating, lifting and lowering the accumulation belt 54. Thus, a control mechanism 100 is configured for controlling various operations of the temporary holder 16.

The elements composing the separation mechanism 30, more specifically, the pickup roller 34, the feed roller 40, and the gate roller 42, and additionally the impellers 52 disposed on the side of the gate roller 42 are operated to rotate by a separation mechanism driving machine such as the separation motor 72 controlled by the controller 70.

The impellers 52 serving as components of the impeller elevating mechanism 80 in charge of vertical lifting and lowering operations for the impellers 52, and the pressing plate 38 serving as a component of the pressing plate mechanism 82 in charge of vertical operation of the pressing plate 38 are operated to be lifted and lowered by a pressing plate driving machine such as the pressing motor 74 controlled by the controller 70.

The accumulation belt 54 serving as a component of the belt mechanism 84 in charge of rotational operation of the accumulation belt 54 is turned by an accumulation belt rotational driving machine such as the accumulation belt motor 76 controlled by the controller 70. Further, the accumulation belt 54 serving as the component of the belt mechanism 84 in charge of lifting and lowering operation of the accumulation belt 54 is operated to be lifted and lowered by an accumulation belt driving machine such as the evacuating motor 78 controlled by the controller 70. The belt mechanism 84 means parts and members provided for receiving the driving force from the motors 76 and 78 to turn or lift and lower the accumulation belt 54. In addition to the accumulation belt 54, many parts, for example, the pulleys 56 and the shaft 58, are included as elements of the belt mechanism 84.

The sensor 64 senses whether or not a bill is set into the temporary holder 16 under the control of the controller 70.

Subsequently, the accumulating operation of the temporary holder 16 of the above configuration will be described with reference to FIG. 5, a flowchart showing the accumulating operation, and FIGS. 6 to 11, side views of the temporary holder 16.

Figure 5:
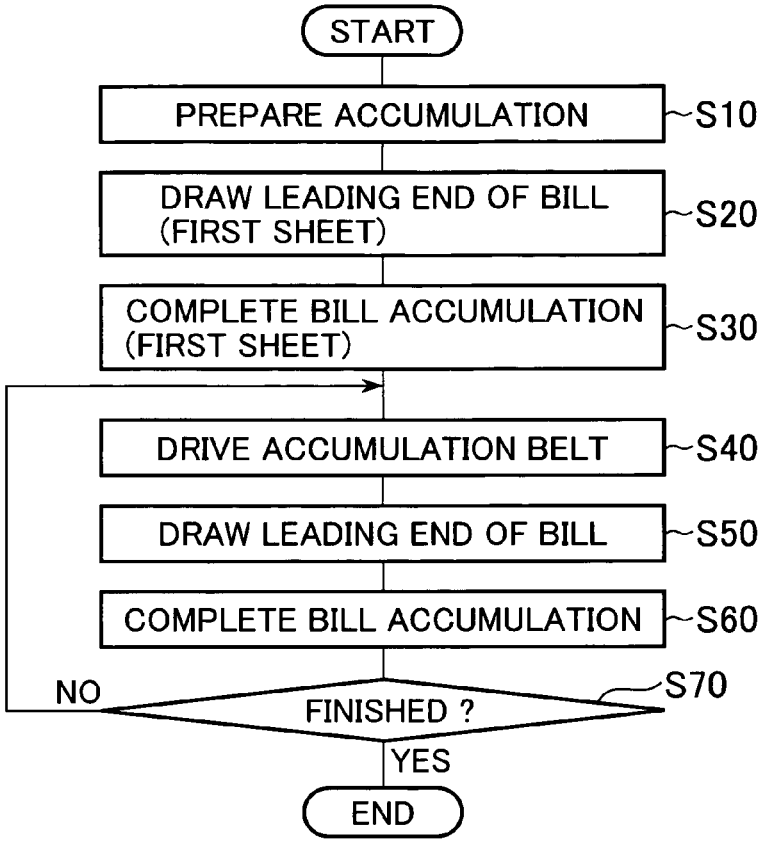
FIG. 5 is a flowchart showing the accumulating operation of the temporary holder, gateway and storage shown in FIG. 1.
Figure 6:
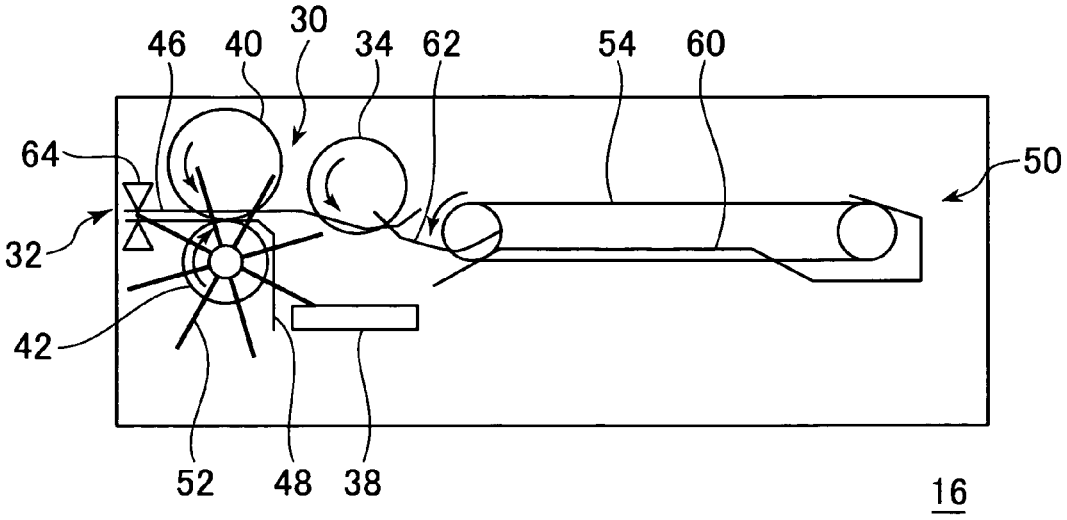
FIGS. 6 through 11 are side views for illustrating the accumulating operation of the essential portion of the temporary holder shown in FIG. 1.

First, as shown in step S10 in FIG. 5, the controller 70 controls the respective mechanisms so as to cause the temporary holder 16 to prepare to accumulate bills. In detail, the controller 70 controls the pressing motor 74 to lift the impellers 52 and lower the pressing plate 38. Further, the controller 70 controls the evacuating motor 78 to lower the accumulation belt 54. By this operational control, as shown in FIG. 6, the impellers 52, the pressing plate 38 and the accumulation belt 54 are brought to the accumulation preparing positions thereof.

After those elements have been brought to their accumulation preparing positions, the controller 70 drives the separation motor 72. That causes the pickup roller 34, the feed roller 40, the gate roller 42 and the impellers 52 to rotate so as to be able to draw a bill sent to the bill delivery part 32 via the conveyance unit 20 and the like. Further, the controller 70 drives the accumulation belt motor 76 to rotate the accumulation belt 54 so as to further draw the bill sent from the separation mechanism 30. The rotational directions are specifically shown by arrows in FIG. 6.

Figure 7:
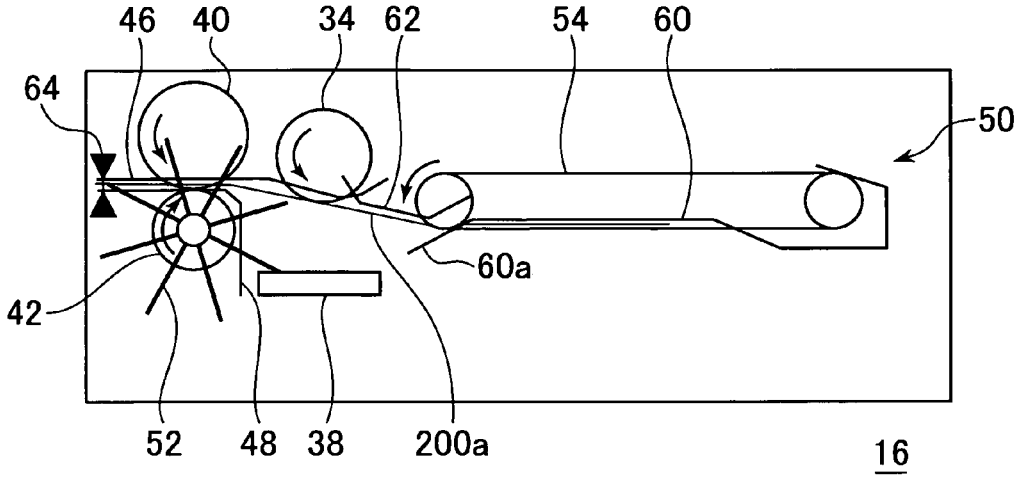

Next, the apparatus proceeds to an operation for drawing the leading end of a bill, as is shown in step S20 in FIG. 5. The graphic situation of this step is shown in FIG. 7. The leading end of a first bill 200*a* sent into the temporary holder 16 from the outside through the conveyance section 20 and the like is sensed by the sensor 64. Then, the bill 200*a* is sent into the separation mechanism 30 with guidance of the sheet guides 46 and 48 in response to the rotation of the pickup roller 34, the feed roller 40, the gate roller 42 and the impellers 52. Further, the leading end of the bill 200*a* is guided by the sheet guides 62 and the receivers 60*a* to enter between the accumulation belt 54 and the sheet guides 60. The bill 200*a* entering between the accumulation belt 54 and the sheet guides 60 is caught by the accumulation belt 54 and the sheet guides 60 to be drawn into the accumulation mechanism 50 by the force received from the accumulation belt 54 rotating.

Figure 8:
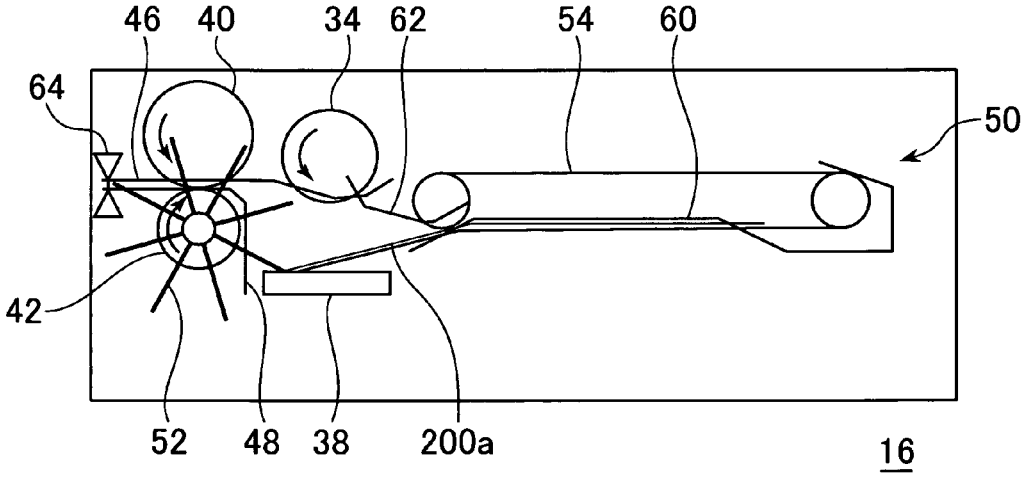
Figure 9:
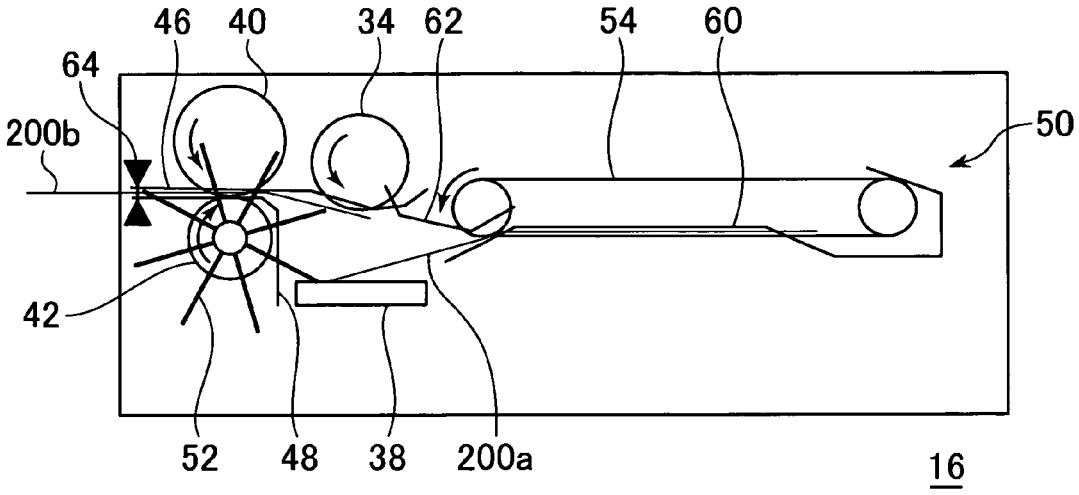

When the rear end of the bill 200*a* is sensed by the sensor 64, the controller 70 executes a bill accumulation finishing operation shown in step S30 in FIG. 5. Specifically, as shown in FIG. 8, when the rear end of the bill 200*a* is sensed, the rear end of the bill 200*a* is completely drawn into the temporary holder 16, and thereafter, upon a predetermined time elapsing for drawing the rear end of the bill 200*a* to a position at which it is possible to slap down the rear end of the bill 200*a* by the impellers 52, the accumulation belt motor 76 is stopped. The rotation of the accumulation belt 54 thus ceases, terminating the accumulation of the first bill 200*a*.

When a succeeding bill 200*b* is sent from the outside of the temporary holder 16, and the leading end of the bill 200*b* is sensed by the sensor 64, the controller 70 executes an accumulation belt drive operation in step S40. After the leading end of the bill 200*b* is sensed, and a predetermined time elapses for drawing the bill 200*b* to a position at which it is possible to guide the leading end of the bill 200*b* by the sheet guides 60, the accumulation belt motor 76 is driven to rotate the accumulation belt 54 in the direction in which a bill is drawn into the accumulation mechanism 50, i.e. in the counterclockwise direction in FIG. 9.

Figure 10:
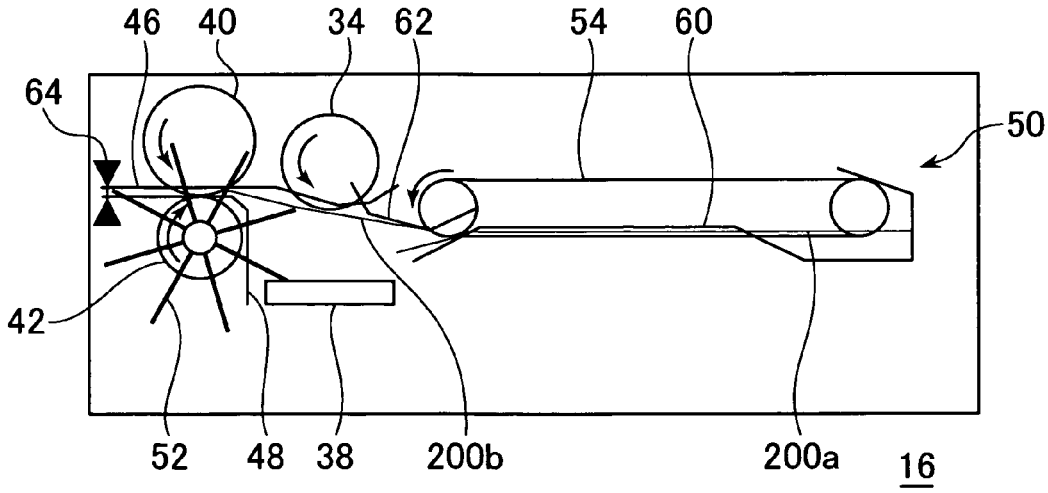

Next, the controller 70 executes an operation for drawing a bill leading end, as is shown in step S50 in FIG. 5. When the accumulation belt 54 is rotated, as shown in FIG. 10, the leading end of the bill 200*b* is guided by the sheet guides to enter between the accumulation belt 54 and the sheet guides 60. The bill 200*b* entering between the accumulation belt 54 and the sheet guides 60 is caught by the accumulation belt 54 and the sheet guides 60 to be drawn into the accumulation mechanism 50 by the force received from the accumulation belt 54 rotating.

Figure 11:
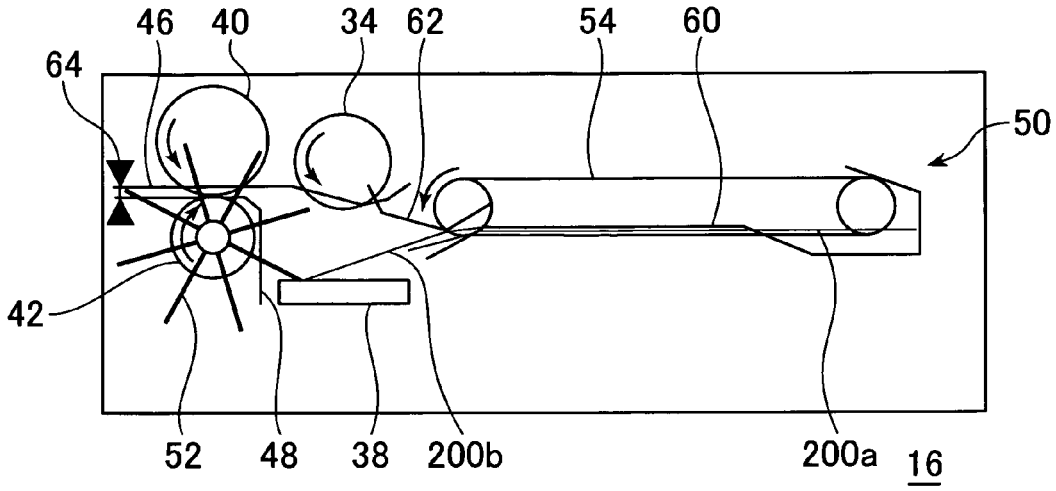
Figure 12:
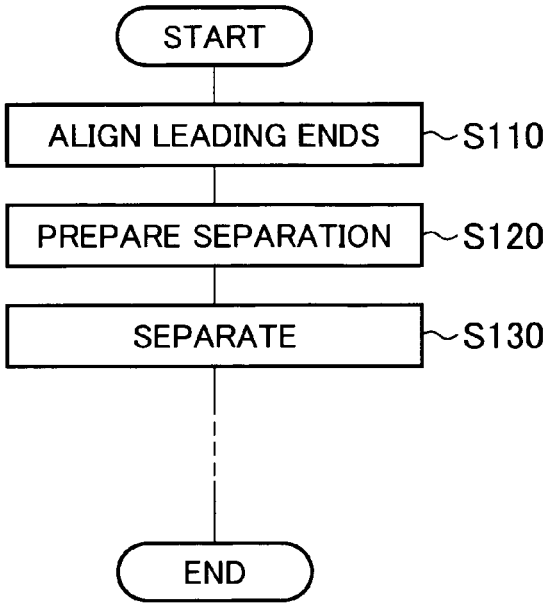
FIG. 12 is a flowchart showing the separating operation of the temporary holder and the gateway shown in FIG. 1.

When the rear end of the bill 200*b* is sensed by the sensor 64, the controller 70 executes a bill accumulation finishing operation shown in step S60 in FIG. 5. Specifically, upon a reception of the rear end of the bill 200*b* being sensed, the rear end of the bill 200*b* is completely drawn into the temporary holder 16 as shown in FIG. 11, and thereafter, upon the predetermined time elapsing for drawing the bill 200*b* to a position at which it is possible to slap down the rear end of the bill 200*b* by the impellers 52, the accumulation belt motor 76 is stopped, causing the rotation of the accumulation belt 54 to stop. Thus, the accumulation of the bill 200*b* terminates.

When the accumulation of the bill 200*b* is terminated, the controller 70 determines whether or not the accumulation of all the bills to be accumulated is completed (step S70). When it is determined that there are succeeding bills to be accumulated, the control returns to the processing in step S40 to continue the accumulating operation for the succeeding bills. By contrast, when it is determined that there is no succeeding bill, the controller 80 disables the separation motor 72 to stop the rotation of the pickup roller 34, the feed roller 40, the gate roller 42 and the impellers 52, thus terminating the accumulating operation.

Since the bills are accumulated by such configuration and operation, a time required for preparation to accumulate bills conveyed from the conveyance section 20 is only a short period from the start of driving the accumulation belt motor 76 till the speed of the accumulation belt 54 becoming stable. Accordingly, it is possible to shorten an interval between bills to be conveyed, thus making it possible to shorten a processing time for counting bills.

Further, the leading end of a bill sent into the temporary holder 16 is guided by the sheet guides 62 to enter between the accumulation belt 54 and the sheet guides 60. The bill is then caught by the accumulation belt 54 and the sheet guides 60 to be accumulated in the temporary holder 16. That effectively makes it possible to shorten a time for the preparing operation to accumulate bills, and hence to shorten a time for the bill accumulating operation.

Moreover, since a bill received from the outside of the temporary holder 16 is caught by the accumulation belt 54 and the sheet guides 60 to be drawn into the temporary holder 16, it is possible to attain the advantage that there is no risk of causing mechanical malfunction such as bill jamming otherwise occurring due to the bill knocking the pressing plate 38 or bills accumulated on the pressing plate.

Next, the separating operation of the separation mechanism 30 in the temporary holder 16 will be described according to steps in a flowchart shown in FIG. 12, and FIGS. 13 to 16 which are side views of the temporary holder 16.

Figure 13:
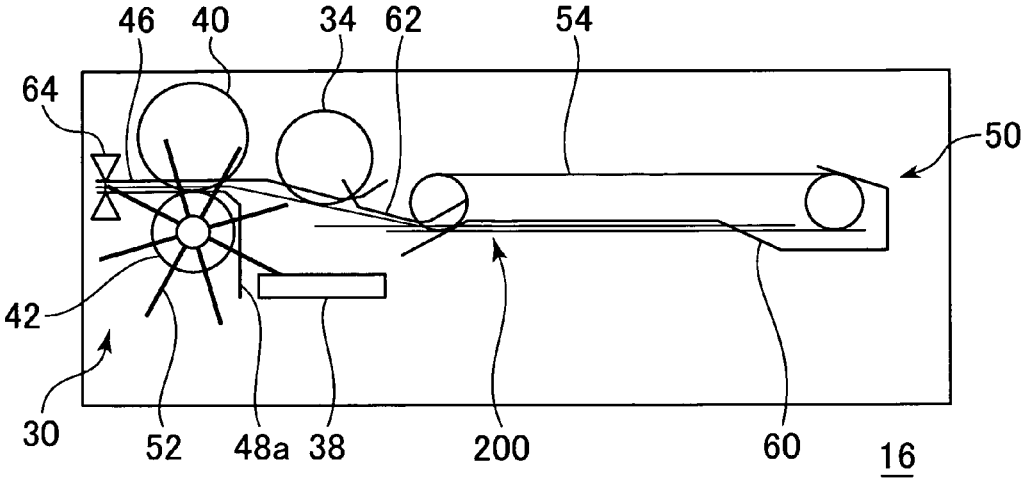
FIGS. 13 through 16 are side views for illustrating the separating operation of the essential portion of the temporary holder shown in FIG. 1.
Figure 14:
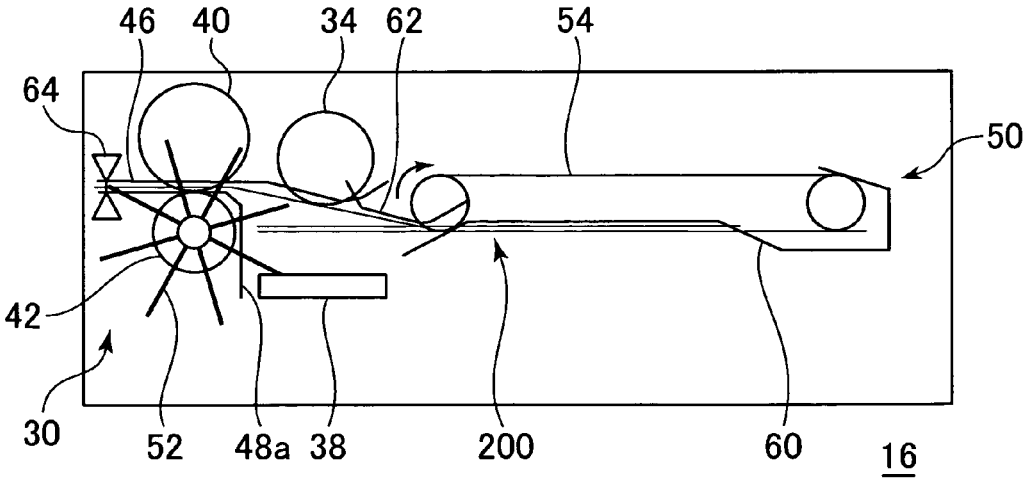

As shown in FIG. 13, the separating operation is to start in a state in which the accumulating operation for the bills 200 is completed, and from the positions at which the impellers 52 are lifted with the pressing plate 38 lowered, and at which the accumulation belt 54 is lowered as well. In addition, in the state of FIG. 13, the accumulated bills 200 are caught between the accumulation belt 54 and the sheet guides 60 and the leading ends of the bills 200 are not aligned.

First, the step of aligning the leading ends (step S110) will be described. The controller 70 drives the accumulation belt motor 76 to rotate the accumulation belt 54 in the clockwise direction shown by an arrow in FIG. 14, that is, in a direction in which the bills 200 are sent out from the accumulation mechanism 50 toward the separation mechanism 30. When the accumulation belt 54 rotates in this way, the bills 200 strike against the vertical wall surface 48*a* of the sheet guide 48 in due course. The controller stops the accumulation belt motor 76 after the elapse of a predetermined time while striking the bills 20*a* against the wall 48*a*. This operation can align the leading ends of the accumulated bills 200.

Figure 15:
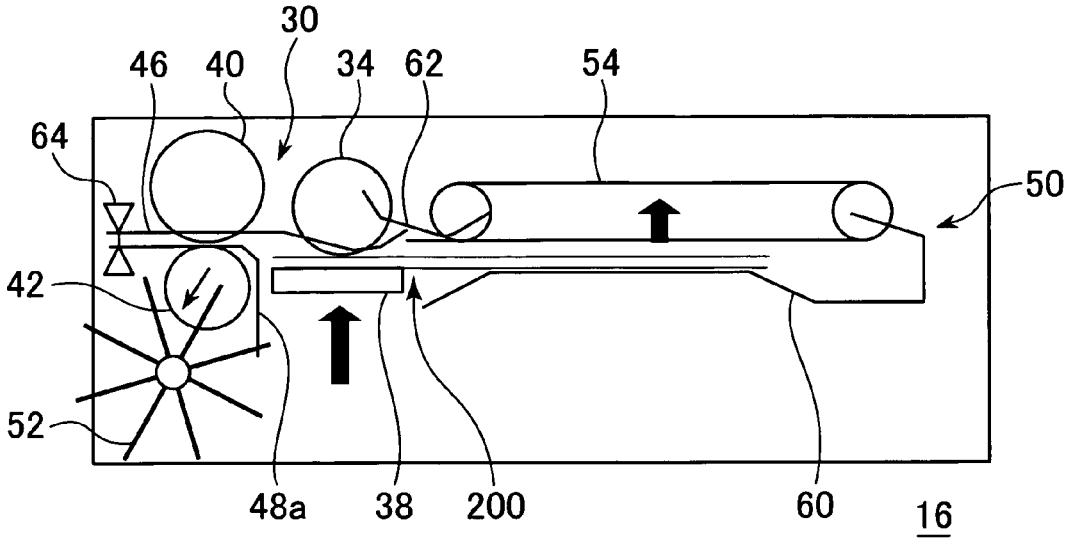

When the leading ends of the bills 200 are aligned, the controller 70 executes a separation preparing operation in step S120. The pressing motor 74 is driven to lower the impellers 52, as shown in FIG. 15, so as not to interfere with the separation of the bills 200, and lifts the pressing plate to press the leading ends of the accumulated bills 200 against the pickup roller 34. The pressing motor 74 is stopped as in the state of pressing the bills 200 against the pickup roller 34.

Further, the controller 70 drives the evacuating motor 78 to lift the accumulation belt 54. This lifting of the accumulation belt 54 is an operation of evacuating the accumulation belt 54 in order not to cause the accumulation belt 54 to interfere with the separating work for the bills 200 which will be performed in the following step. The impellers 52, the pressing plate 38 and the accumulation belt 54, when positioned in this way as shown in FIG. 15, are prepared for the separation operation.

Figure 16:
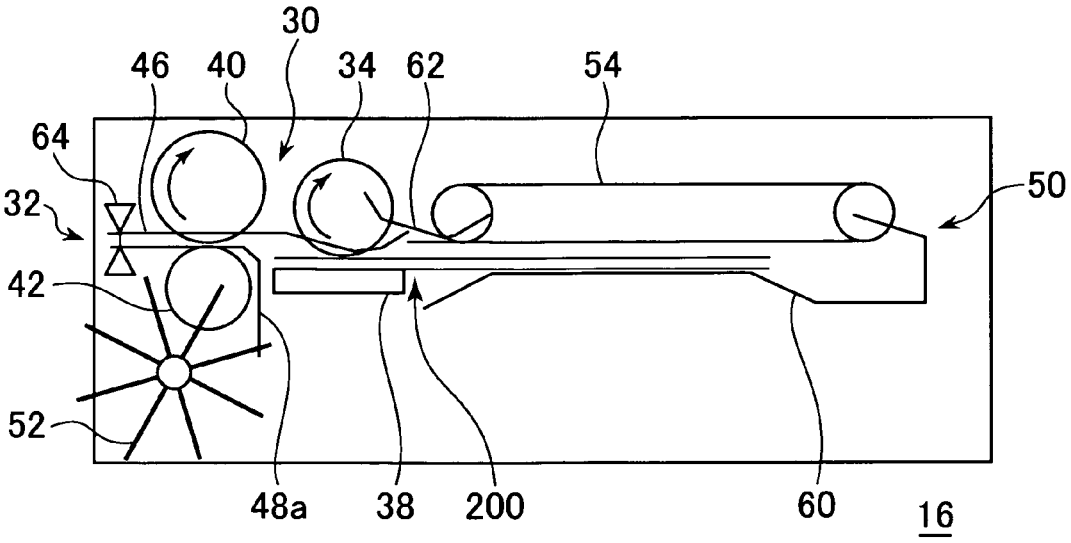

When the impellers 52, the pressing plate 38 and the accumulation belt 54 take the positions for the separation preparation, the controller 70 drives the separation motor 72 to rotate the pickup roller 34 and the feed roller 40 in a direction for sending out a bill from the bill delivery part 32 to the outside of the temporary holder 16, i.e. in the clockwise direction in FIG. 16.

When the pickup roller 34 and the feed roller 40 are rotated, the bills pressed against the pickup roller 34 by the pressing plate 38 are separated from each other to be fed out to the outside of the temporary holder 16.

The separation of accumulated bills is performed by the configuration and operation as described above. Accordingly, the temporary holder 16 capable of accumulating bills more advantageously than the conventional art can smoothly perform the separation of accumulated bills as well.

Next, the gateway 14 in which the separation and accumulation mechanisms 30 and 50 are placed will be described. First, the configuration thereof will be described with reference to FIGS. 17, 18 and 19. In addition, the components similar to those also employed in the temporary holder 16 are indicated by the same reference numerals, a detailed description thereon will not be repeated in order to avoid redundancy.

The gateway 14 has a channel 86 communicating with the opening part formed in the customer interface 12 is formed. The channel 86 serves as a channel to receive a bill inserted from the customer interface 12, and further to discharge a bill to the customer interface 12. The channel 86 communicates with the accumulation mechanism 50 inside the gateway 14.

The gateway 14 preferably has a shutter 88 for opening and closing the channel 86. The opening and closing of the shutter 88 is more preferably performed by a driving machine such as a shutter motor 90, not shown in FIGS. 17 and 18. The opening and closing of the shutter 88 is performed such that the controller 70 drives the shutter motor 90 to control a shutter mechanism 92 for opening and closing the shutter 88. The configurational relationship in control aspect between the shutter 88, the shutter motor 90 and the shutter mechanism 92 will be described later in detail, and is shown in FIG. 19.

Further, the gateway 14 has a sheet guide 94 installed along the upper side of the channel for bills formed by the channel 86. The sheet guide 94 is adapted to guide a bill inserted from the customer interface 12 to the inside of the gateway 14, and to guide a bill discharged from the inside of the gateway 14 to the customer interface 12. It is to be noted with the present embodiment that, under bills formed by the channel 86, sheet guides are installed as well, which are formed by extensions of the sheet guides 60 in the accumulation mechanism 50 to reach the channel 86.

The accumulation mechanism 50 included in the embodiment of the gateway 14 has the accumulation belt 54, the sheet guides 60 and 62, the impellers 52 and the sensor 64 serving as a bill conveyor in the same way as the embodiment of the temporary holder 16. In addition, the accumulation mechanism 50 in the gateway 14 has, at a position facing the lower part of the accumulation belt 54, a lump conveyor belt 94 arranged for catching lumped bills against the accumulation belt 54 to convey them.

Figure 17:
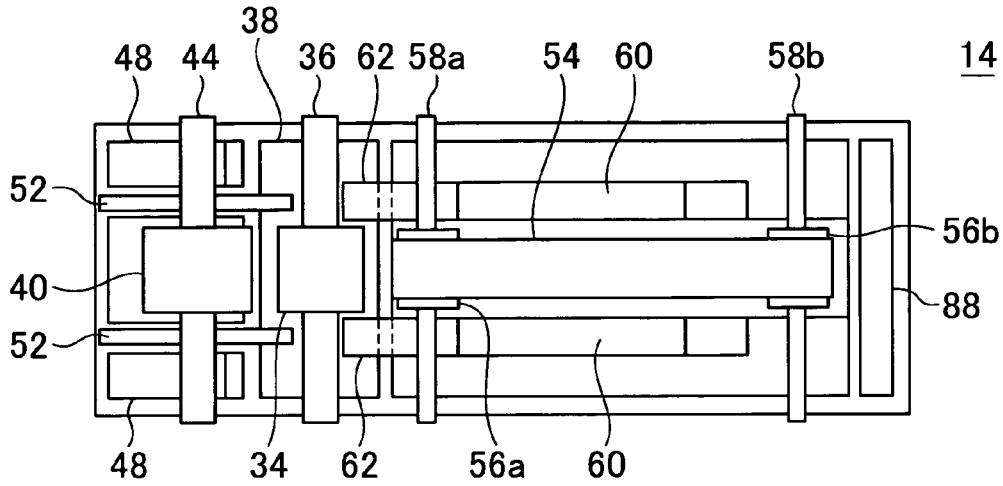
FIG. 17 shows in a top view the essential portion of the gateway shown in FIG. 1.
Figure 18:
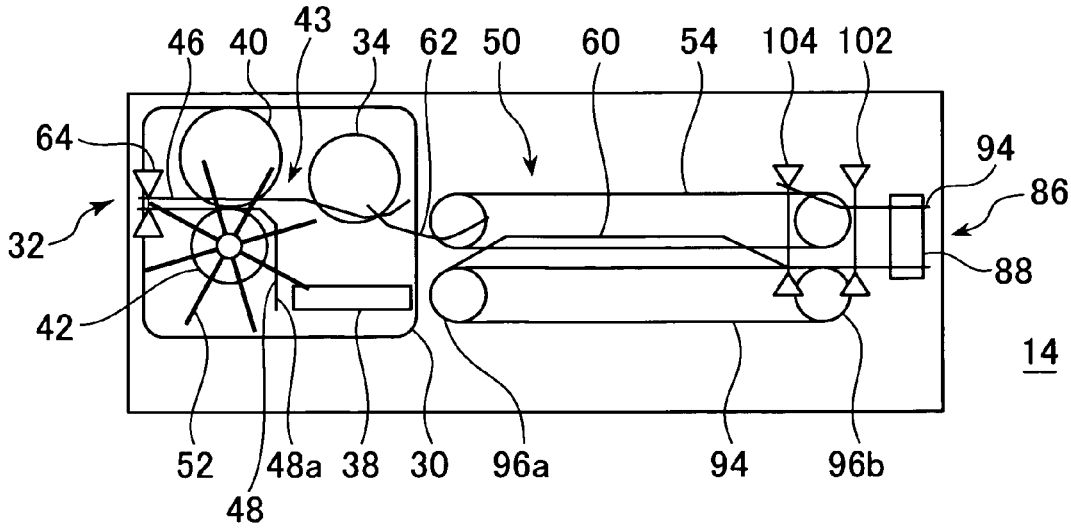
FIG. 18 shows in a side view the essential portion of the gateway shown in FIG. 1.
Figure 19:
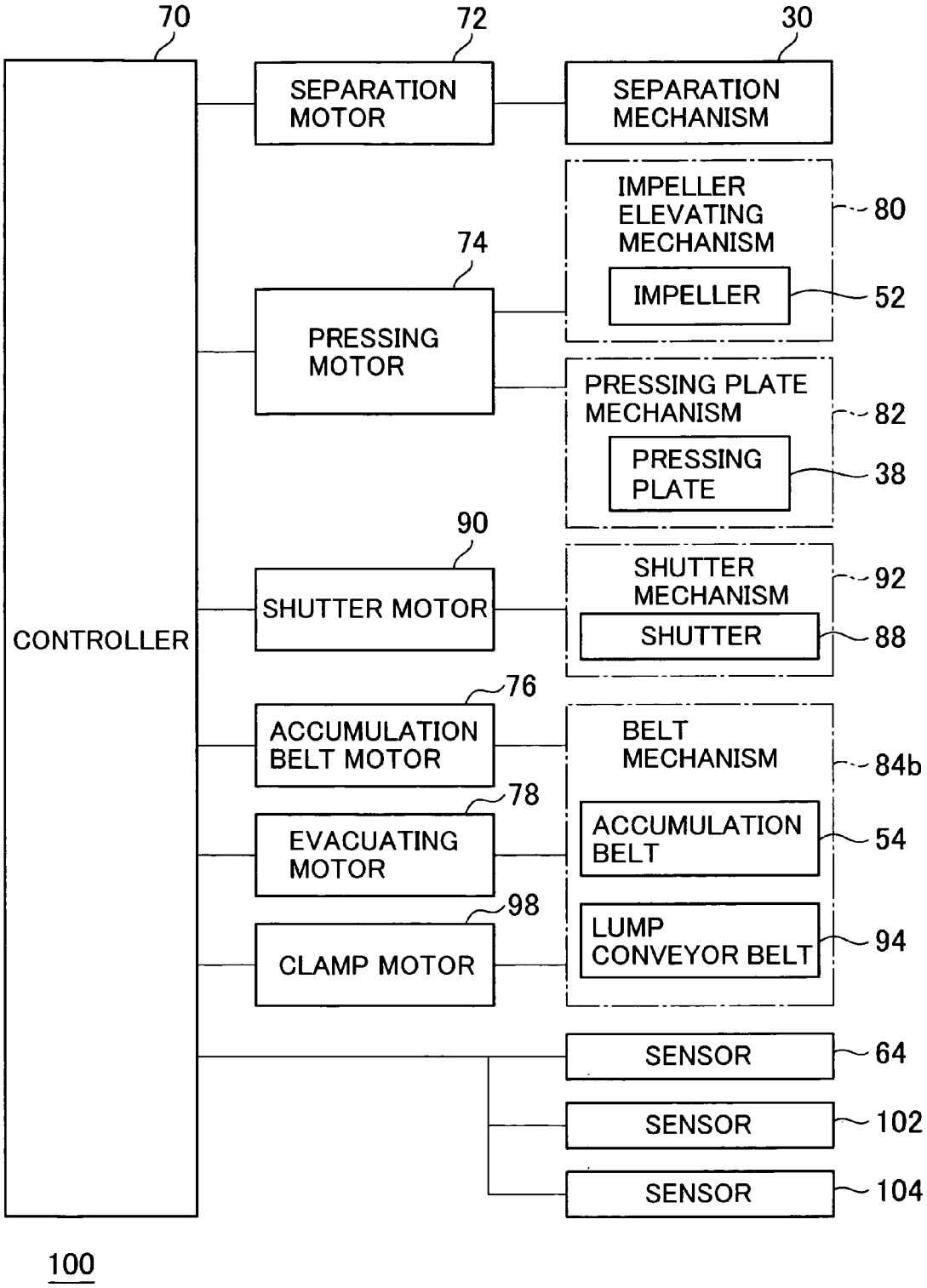
FIG. 19 is a block diagram showing the configuration of a control system of the gateway shown in FIG. 1.
Figure 20:
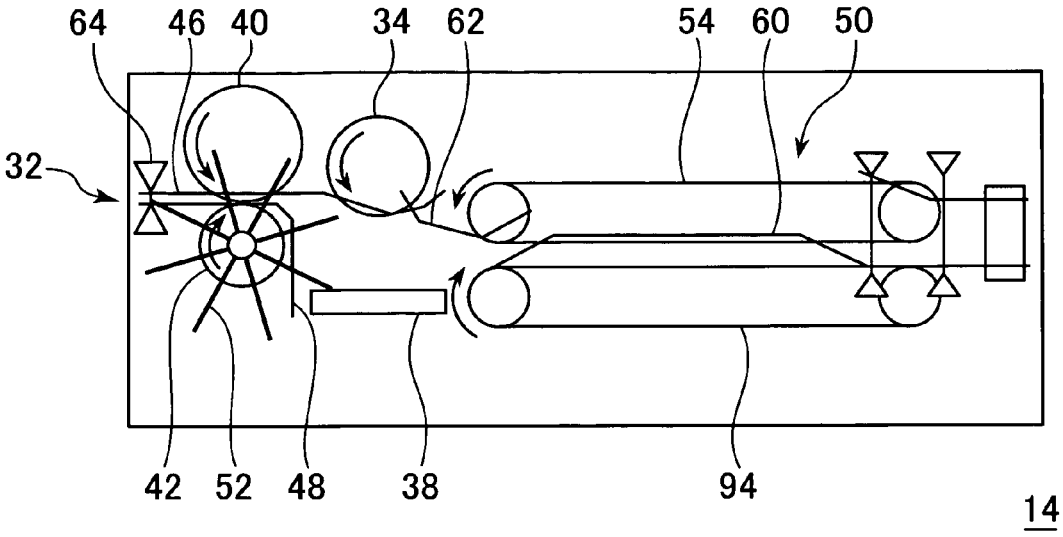
FIGS. 20 through 25 are side views for illustrating the accumulating operation of the essential portion of the gateway shown in FIG. 1.

The lump conveyor belt 94 is an endless belt formed of an elastic material such as rubber in the same way as the accumulation belt 54, and bridges pulleys 96*a* and 96*b* which are components of a belt mechanism 84*b*, not shown in FIGS. 17 and 18. The belt mechanism 84*b* in the gateway 14 means parts and members provided for turning, lifting and lowering the accumulation belt 54 and the lump conveyor belt 94 by the driving force received from the motors 76 and 78 and the like.

The pulleys 96*a* and 96*b* are rotated by the driving machine such as the accumulation belt motor 76, not shown in FIGS. 17 and 18. This rotational operation causes the lump conveyor belt 94 to rotate. Further, the lump conveyor belt 94 is rotated synchronously with the accumulation belt 54 in a direction opposite to the rotational direction of the accumulation belt 54 by the accumulation belt motor 76, thus being capable of conveying the lumped bills. In addition, the configurational relationship in control aspect between the lump conveyor belt 94, the belt mechanism 84*b* and the accumulation belt motor 76 is shown in FIG. 19.

Further, the lump conveyor belt 94 is configured to be capable of being lifted and lowered by a driving machine such as a clamp motor 98, and by the belt mechanism 84*b* serving also as a mechanism for lifting and lowering the lump conveyor belt 94, the motor 98 and the belt mechanism 84*b* not being shown in FIGS. 17 and 18. The configurational relationship in control aspect between the lump conveyor belt 94, the belt mechanism 84*b* and the clamp motor 98 is shown in FIG. 19.

Since the lump conveyor belt 94 has this configuration, it possible to catch a bill inserted from the customer interface 12 by the lump conveyor belt 94 and the accumulation belt 54 to convey the bill to the inside of the gateway 14, and to catch a bill discharged from the inside of the gateway 14 to convey the bill to the customer interface 12.

The gateway 14 has sensors 102 and 104 for sensing the leading and rear ends of a bill passing thorough the channel 86. In the instant embodiment, the sensor 102 is disposed nearer the shutter 88 than the sensor 104 is. The sensor 102 can sense the rear end of a bill discharged to the customer interface 12 from the inside of the gateway 14 and further the rear end of a bill drawn into the gateway 14. In the meanwhile, the sensor 104 is disposed, for example, near the pulley 96*b* rotating the lump conveyor belt 94, and capable of sensing the leading end of a bill inserted from the customer interface 12.

Next, the configuration in control aspect between the separation mechanism 30 and the accumulation mechanism 50 in the gateway 14 will be described with reference to FIG. 19.

The controller 70 with which the bill processor 10 is equipped is responsive to control programs, or software, stored in the memory, not shown, to control the entire gateway 14 by means of the separation motor 72, the pressing motor 74, the shutter motor 90 for opening and closing the shutter 88, the accumulation belt motor 76, the evacuating motor 78, the clamp motor 98 for lifting and lowering the lump conveyor belt, the sensors 64, 102 and 104, and the like. That forms the control mechanism 100 for controlling various operations of the gateway 14.

The relationship of the separation motor 72 for mainly use in controlling the operation of the separation mechanism 30 and the pressing motor 74 for use in controlling the operation of the impeller elevating mechanism 80 and the pressing plate mechanism 82 with respect to the controller 70 is the same as the embodiment of the configuration in control aspect shown in FIG. 4.

When the controller 70 controls the driving of the shutter driving machine such as the shutter motor 90, the shutter 88 is operated to open and close via the shutter mechanism 92 to cause the shutter 88 to open and close.

In the gateway 14 according to the present embodiment, the accumulation belt 54 and the lump conveyor belt 94 are components of the belt mechanism 84*b* for performing conveyance, accumulation and the like for bills. The accumulation belt 54 and the lump conveyor belt 94 are operated to rotate by the accumulation belt motor 76 under the control of the controller 70. Further, the accumulation belt 54 is operated to be lifted and lowered by the evacuating motor 78 under the control of the controller 70, while the lump conveyor belt 94 is operated to be lifted and lowered by a lump conveyor belt driving machine such as the clamp motor 98 under the control of the controller 70.

The sensors 64, 102 and 104 sense the reception and discharge of bills under the control of the controller 80.

Next, the accumulating operation of the gateway 14 having this configuration will be described with reference to the flowchart showing the accumulating operation in FIG. 5, and FIGS. 20 to 25 which are side views of the gateway 14.

First, as an accumulation preparing operation (step S10), the controller 70 drives the pressing motor 74 to lift the impellers 52 and lower the pressing plate 38, and to further lower the accumulation belt 54 and the lump conveyor belt 94 by the evacuating motor 78 and the clamp motor 98. Further, the shutter motor 90 is driven to close the shutter 88. Under this operational control, the impellers 52, the pressing plate 38, the shutter 88, the accumulation belt 54 and the lump conveyor belt 94 are brought to the accumulation preparing positions thereof as shown in FIG. 18.

After those elements are brought into their accumulation preparing positions, the controller 70 drives the separation motor 72. That causes the pickup roller 34, the feed roller 40, the gate roller 42 and the impellers 52 to rotate so as to be able to draw a bill sent from the conveyance channel 20 through the bill delivery slot 32. Further, the controller 70 drives the accumulation belt motor 76 to rotate the accumulation belt 54 and the lump conveyor belt 94 so as to be able to draw the bill sent from the separation mechanism 30 into the accumulation mechanism 50. The rotational directions are specifically shown by arrows in FIG. 20.

Figure 21:
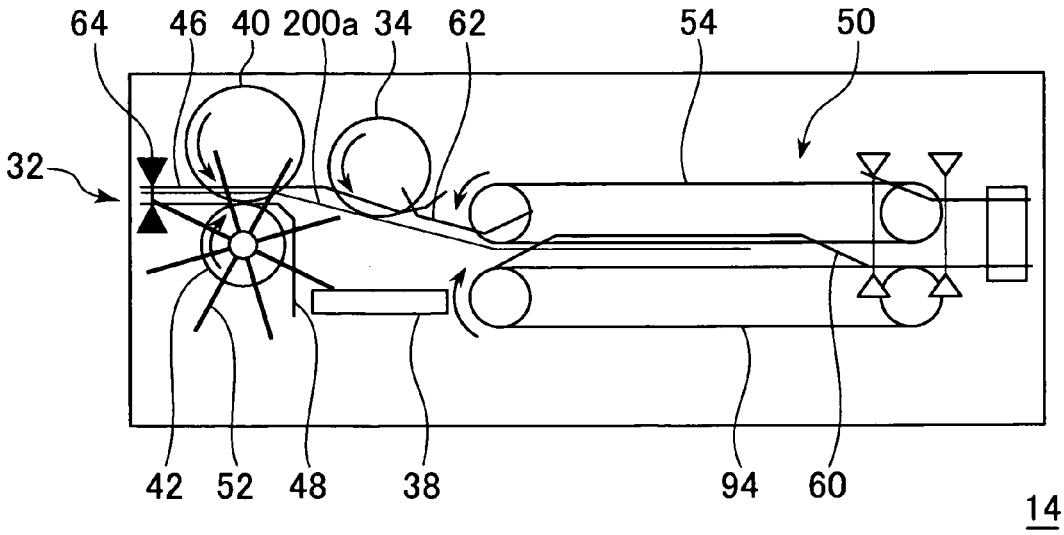

Then, the gateway proceeds to a bill leading end drawing operation shown in step S20 in FIG. 5. The situation of this step is shown in FIG. 21. The leading end of the first bill 200*a* sent into the gateway 14 via the bill delivery slot 32 is sensed by the sensor 64, and the bill 200*a* is sent into the separation mechanism 30 with guidance of the sheet guides 46 and 48 by means of the pickup roller 34, feed roller 40, gate roller 42 and impellers 52 rotating. Then, the leading end of the bill 200*a* is guided by the sheet guides 62 to enter between the accumulation belt 54 and the sheet guides 60. The bill 200*a* entering between the accumulation belt 54 and the sheet guides 60 is caught by the accumulation belt 54 and the sheet guides 60 to be drawn into the accumulation mechanism 50 by the force received from the accumulation belt 54 rotating.

Figure 22:
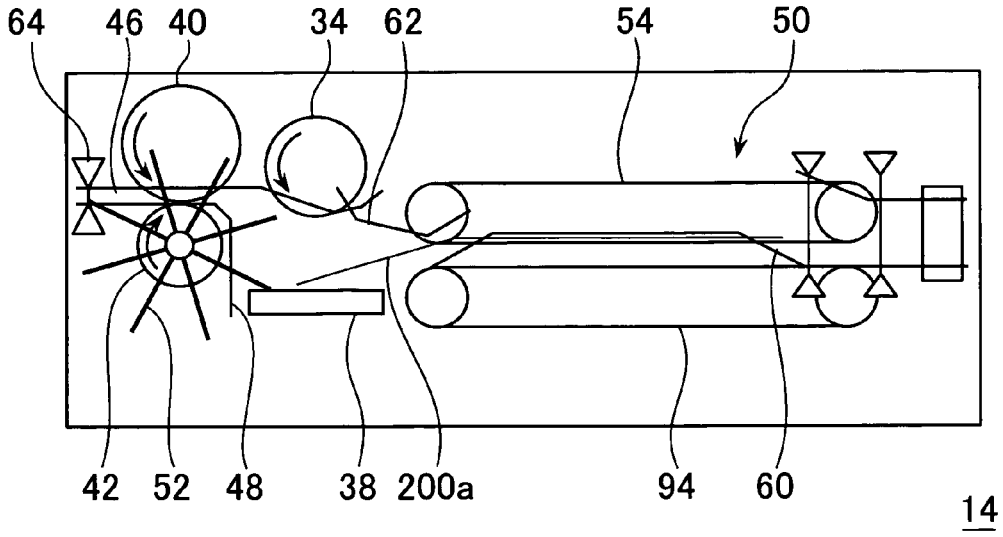
Figure 23:
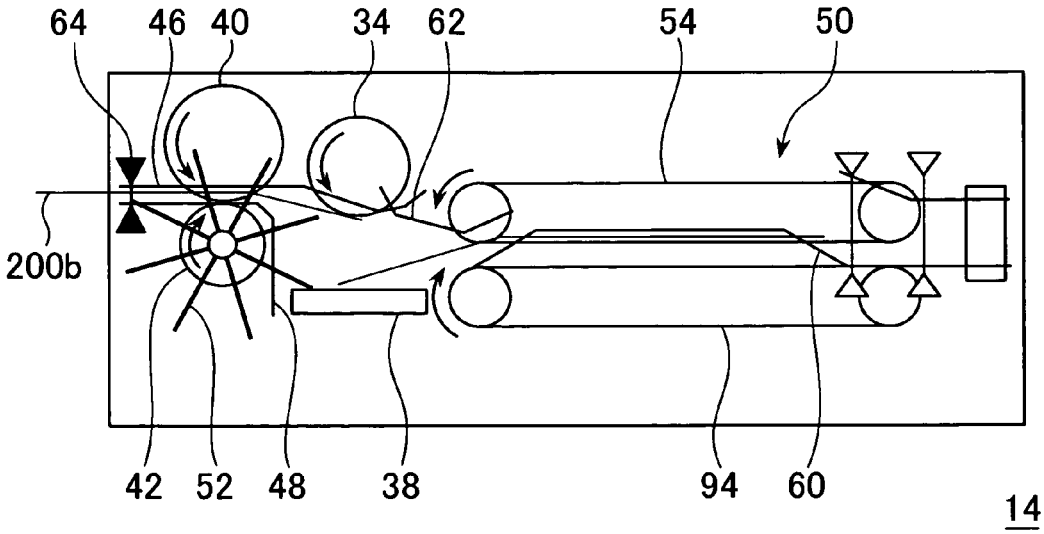

When the rear end of the bill 200*a* is sensed by the sensor 64, the controller 70 executes the bill accumulation finishing operation shown in step S30 in FIG. 5. Specifically, upon a reception of the rear end of the bill 200*a* being sensed, the rear end of the bill 200*a* is completely drawn into the gateway 14, and thereafter, as shown in FIG. 22, upon the predetermined time elapsing for drawing the bill 200*a* to the position at which it is possible to slap down the rear end of the bill 200*a* by the impellers 52, the accumulation belt motor 76 is disabled to cease the rotation of the accumulation belt and the lump conveyor belt 94, thus terminating the accumulation of the first bill 200*a*.

When the leading end of the succeeding bill 200*b* is sensed by the sensor 64, the controller 70 executes an accumulation belt drive operation in step S40. The leading end of the bill 200*b* is sensed, and thereafter, upon the predetermined time elapsing for drawing the bill 200*b* to the position at which it is possible to guide the leading end of the bill 200*b* by the sheet guides 60, the accumulation belt motor 76 is driven to rotate the accumulation belt 54 and the lump conveyor belt 94 in directions in which a bill is drawn into the accumulation mechanism 50, i.e. in directions shown by arrows in FIG. 23.

Figure 24:
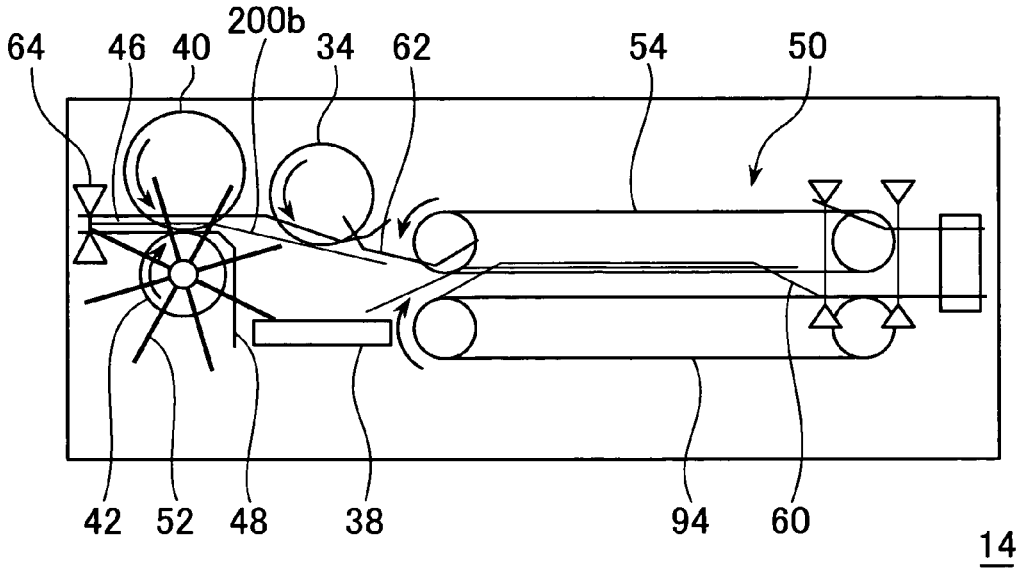

Subsequently, the bill leading end drawing operation in step S50 in FIG. 5 will be executed. When the accumulation belt 54 and the lump conveyor belt 94 are rotated, as shown in FIG. 24, the leading end of the bill 200*b* is guided by the sheet guides 62 to enter between the accumulation belt 54 and the sheet guides 60. The bill 200*b* entering between the accumulation belt 54 and the sheet guides 60 is caught by the accumulation belt 54 and the sheet guides 60 to be drawn into the accumulation mechanism 50 by the force received from the accumulation belt 54 rotating.

Figure 25:
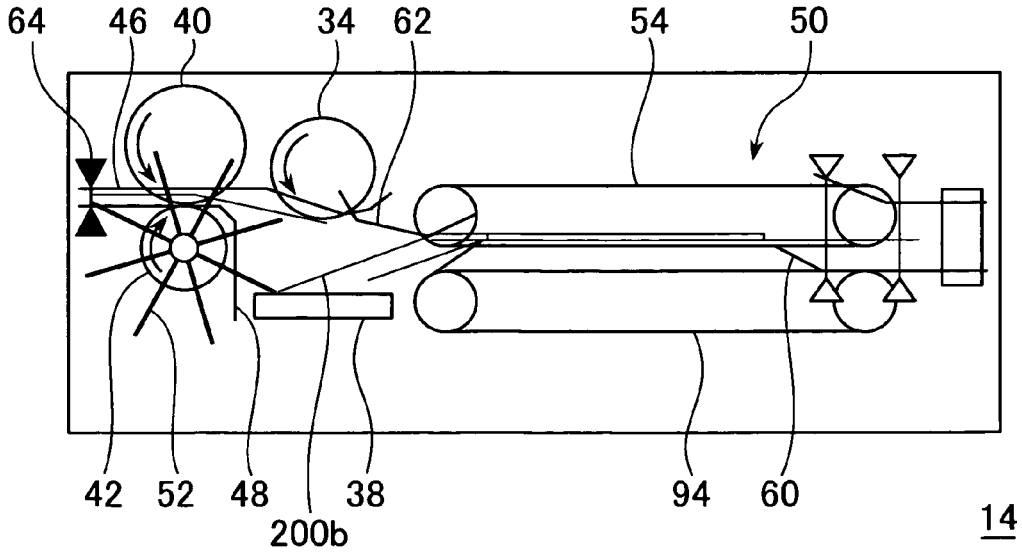
Figure 26:
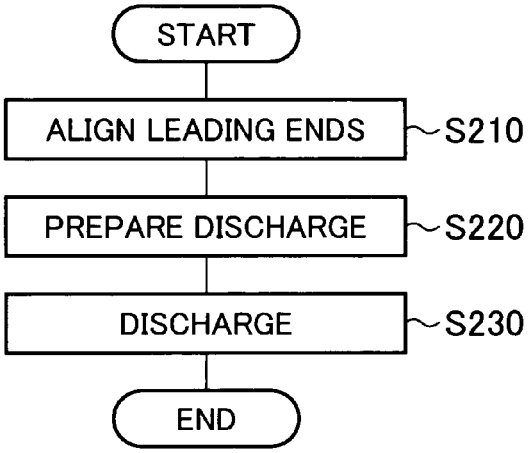
FIG. 26 is a flowchart showing the discharge operation of the gateway shown in FIG. 1.

When the rear end of the bill 200*b* is sensed by the sensor 64, the controller 70 executes the bill accumulation finishing operation in step S60. More specifically, when the rear end of the bill 200*b* is sensed, as shown in FIG. 25, the rear end of the bill 200*b* is completely drawn into gateway 14, and thereafter, upon the predetermined time elapsing for drawing the bill 200*b* to the position at which it is possible to slap down the rear end of the bill 200*b* by the impellers 52, the accumulation belt motor 76 is stopped, causing the rotation of the accumulation belt 54 and the lump conveyor belt 94 to stop, thus terminating the accumulation of the bill 200*b*.

When the accumulation of the bill 200*b* is terminated, the controller 70 determines whether or not all the bills to be accumulated have been piled up (step S70). When it is determined that there are succeeding bills to be accumulated, the gateway returns to the processing in step S40 to continue the accumulating operation for the succeeding bills. On the contrary, when it is determined that there is no succeeding bill, the controller 70 stops the separation motor 72 to cease the rotations of the pickup roller 34, the feed roller 40, the gate roller 42 and the impellers 52, thus terminating the accumulating operation.

Since the bills are accumulated by the forgoing configuration and operation, a time required for preparation to accumulate bills conveyed from the conveyance section 20 is only a short amount time from the start of driving the accumulation belt motor 76 till the speeds of the accumulation belt 54 and the lump conveyor belt 94 becoming stable. Accordingly, it is possible to shorten an interval between bills to be conveyed, thus eventually making it possible to shorten a processing time for counting bills.

Further, because the leading end of a bill sent into the gateway 14 is guided by the sheet guides 62 to enter between the accumulation belt 54 and the sheet guides 60, and the bill is caught by the accumulation belt 54 and the sheet guides 60 to be accumulated in the gateway 14, it is effectively possible to shorten a time for the preparing operation to accumulate bills, and hence to shorten a time for the bill accumulating operation.

Moreover, since the bill sent from the outside of the gateway 14 is caught by the accumulation belt 54 and the sheet guides 60 to be drawn into the gateway 14, it is possible to attain the advantage that there is no risk of causing mechanical malfunction such as bill jamming otherwise occurring due to the bill knocking the pressing plate 38 and the bills accumulated on the pressing plate.

Next, the discharge operation of bills from the gateway 14 to the customer interface 12 will be described according to steps in a flowchart shown in FIG. 26, and FIGS. 27 to 29 which are side views of the gateway 14.

The discharge operation begins with an operation of aligning the leading ends (step S210). The controller 70 causes the pressing motor 74 to lift the impellers 52 and lower the pressing plate 38, and further causes the evacuating motor 78 and the clamp motor 98 to lower the accumulation belt 54 and the lump conveyor belt 94. Further, the shutter motor 90 is driven to close the shutter 88. Under this operational control, the impellers 52, the pressing plate 38, the shutter 88, the accumulation belt 54 and the lump conveyor belt 94 are rendered to the discharge preparing positions thereof as shown in FIG. 18.

Figure 27:
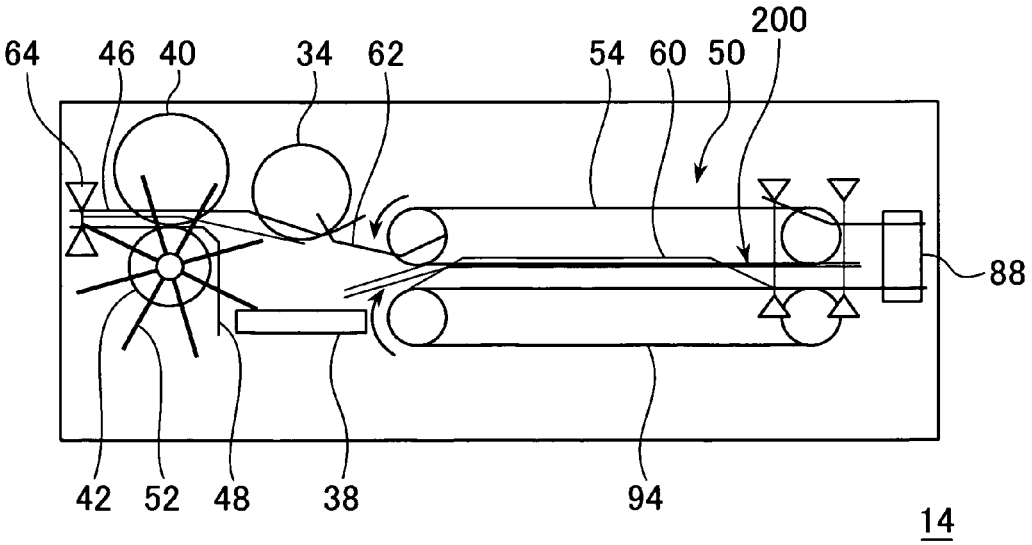
FIGS. 27 through 29 show in side views for illustrating the discharge operation of the essential portion of the gateway shown in FIG. 1.

When the impellers 52 and so on take their discharge preparing positions, the controller 70 drives the accumulation belt motor 76 to rotate the accumulation belt 54 and the lump conveyor belt 94 in directions as shown by arrows in FIG. 27. In response to this rotational movement, the bill 200 caught by the accumulation belt 54 and the sheet guides 60 is brought into abutment against the inner side surface of the closed shutter 88. As a result, the leading ends of the accumulated bills 200 are aligned.

Figure 28:
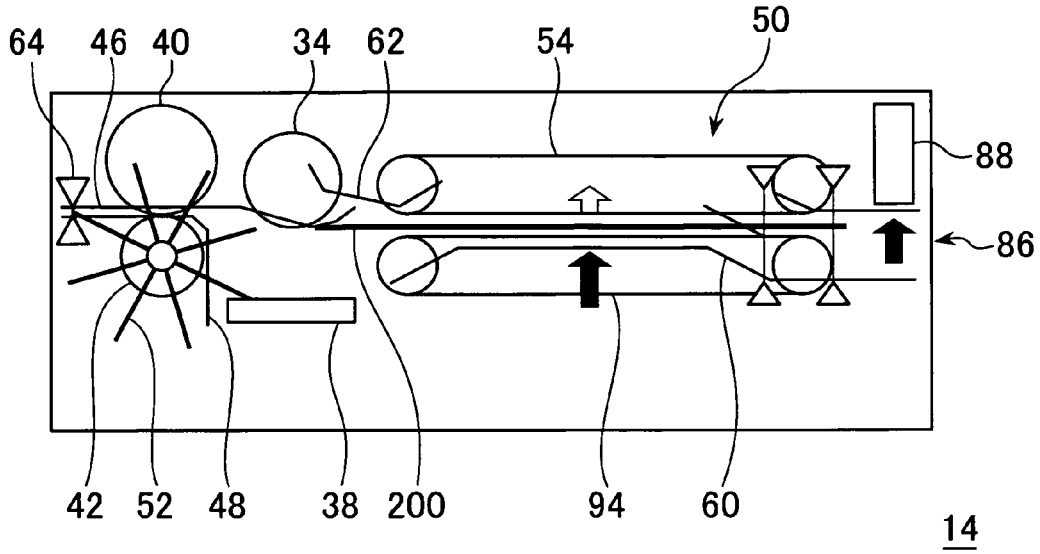

When the leading ends of the bills 200 are aligned, the controller 70 starts an operation for preparing discharge shown by step S220. The clamp motor 98 is driven to lift the lump conveyor belt 94 as shown in FIG. 28. The bills 200 accumulated on the sheet guides 60 are then caught between the accumulation belt 54 and the lump conveyor belt 94. After the bills 200 are caught, the controller 70 stops the clamp motor 98 to keep the bills 200 being caught. Under that state, the controller 70 starts up the shutter motor 90 to open the shutter 88.

Figure 29:
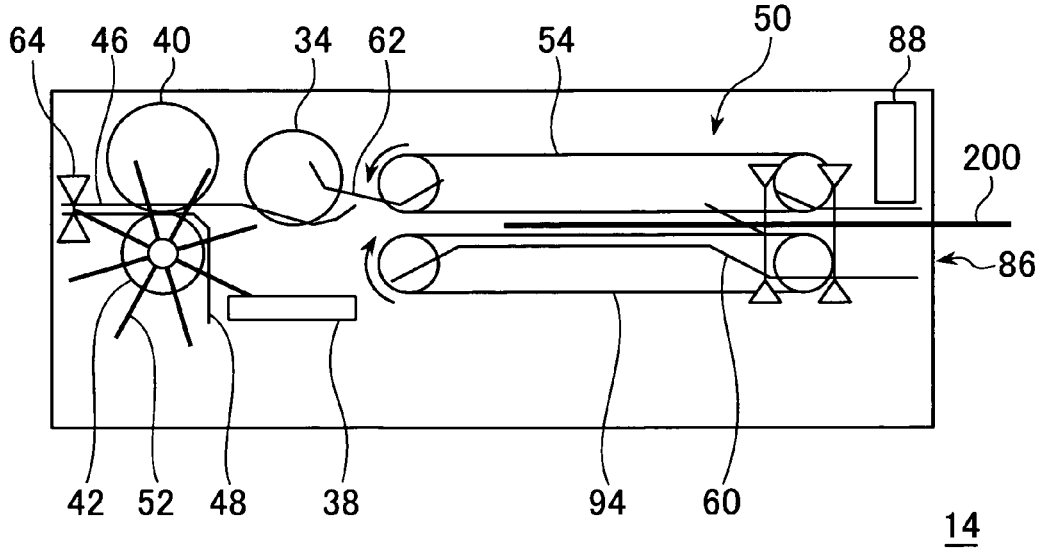
Figure 30:
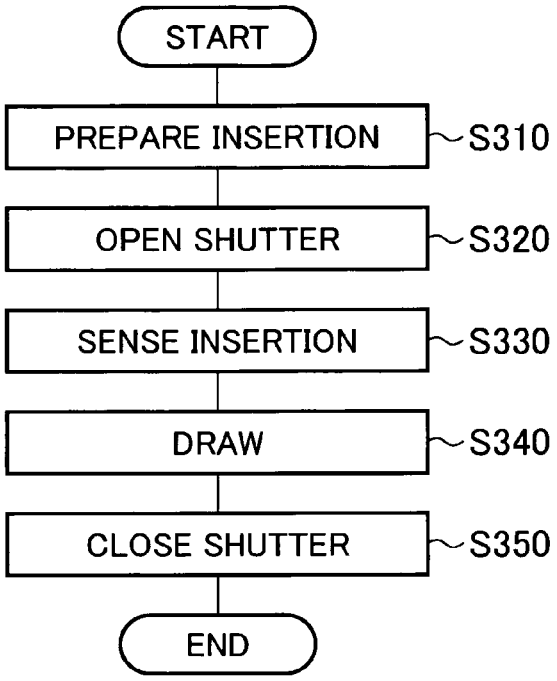
FIG. 30 is a flowchart showing the drawing operation of the gateway shown in FIG. 1.

Subsequently, as a discharge operation (step S230), the controller 70 drives the accumulation belt motor 76 to rotate the accumulation belt 54 and the lump conveyor belt 94 in directions in which the bills 200 are sent out via the channel 86 to the outside, FIG. 29. After the elapse of a predetermined time for transferring the bills 200 to a position at which it is possible for the user to receive the bills, the controller 70 stops the accumulation belt motor 76. In response to the stopping of the motor 76, the rotations of the accumulation belt 54 and the lump conveyor belt 94 are also stopped, thus terminating the discharge operation of the accumulated bills.

Next, the bill drawing operation from the customer interface 12 to the gateway 14 will be described according to steps in a flowchart shown in FIG. 30, and FIGS. 31 to 35 which are side views of the gateway 14.

When starting to draw the bills, the respective elements initially take the positions thereof that are shown in FIG. 18. More specifically, the impellers 52 are lifted to be disposed on the side of the gate roller 42. The pressing plate 38 is lowered. Further, the accumulation belt 54 and the lump conveyor belt 94 are lowered as well. Further, the shutter 88 is closed.

Figure 31:
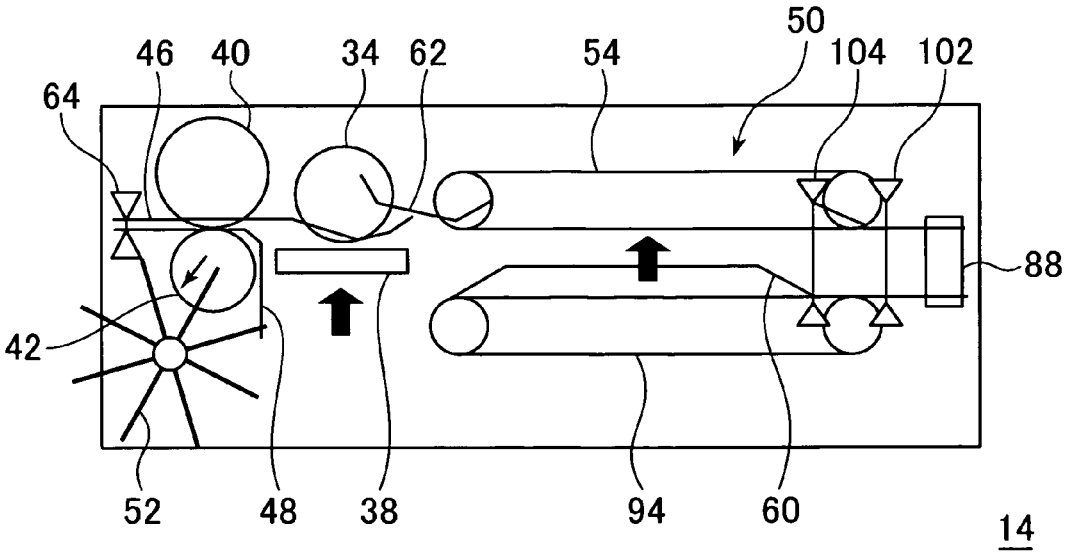
FIGS. 31 through 34 show in side views for illustrating the drawing operation of the essential portion of the gateway shown in FIG. 1.

As an insertion preparing stage shown in step S310, the controller 70 drives the pressing motor 74 to lower the impellers 52 and lift the pressing plate 38. Further, the accumulation belt 54 is lifted by the evacuating motor 78. FIG. 31 shows a state in which the impellers 52, the pressing plate 38 and the accumulation belt 54 take the insertion preparing positions thereof.

Figure 32:
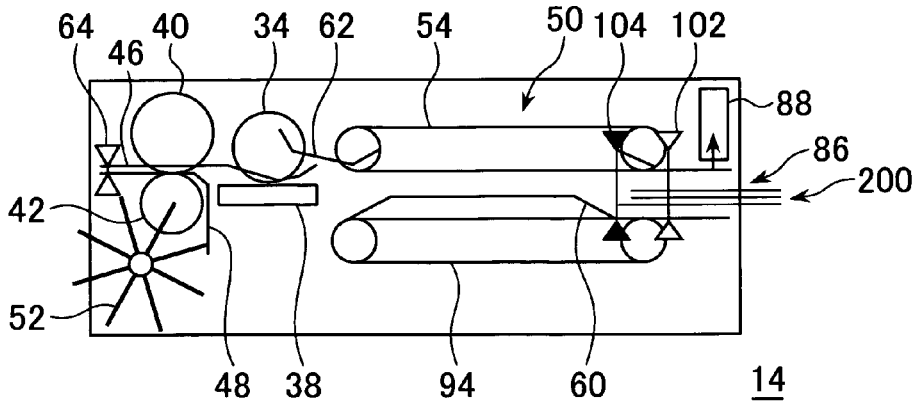
Figure 33:
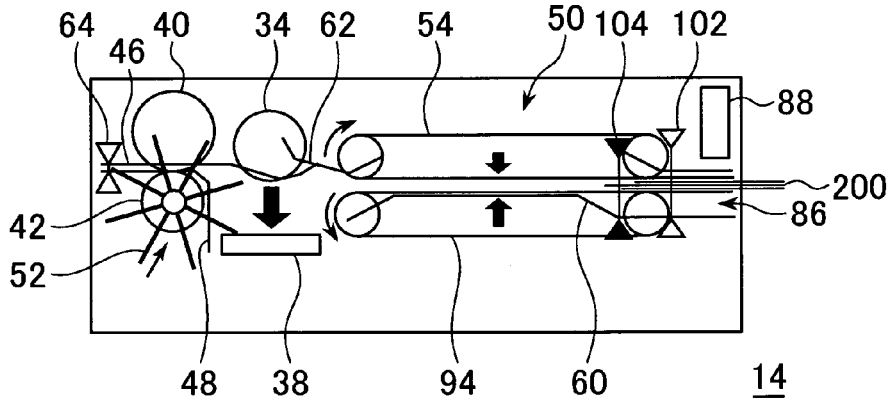

When the insertion preparation is terminated, the controller 70 drives the shutter motor 90 to open the shutter 88 (step S320). That renders the gateway 14 come into its standby state in order for receiving bills on the channel 86. The controller 70 on standby for insertion of bills detects the leading end of the bills with the sensor 104 when the bills 200 are inserted as shown in FIG. 32 (step S330).

When the sensor 104 senses the bills 200 being inserted, the drawing operation in step S340 is started. The controller 70 drives the clamp motor 98 to lift the lump conveyor belt 94, and does the pressing motor 74 to lower the pressing plate 38 and lift the impellers 52. Thereafter, the accumulation belt motor 76 is driven to rotate the accumulation belt 54 and the lump conveyor belt 94 in directions in which the bills 200 in the channel 86 are drawn into the gateway 14, see arrows in FIG. 33. That causes the bills 200 caught between the accumulation belt 54 and the lump conveyor belt 94 are fed into the gateway 14.

Figure 34:
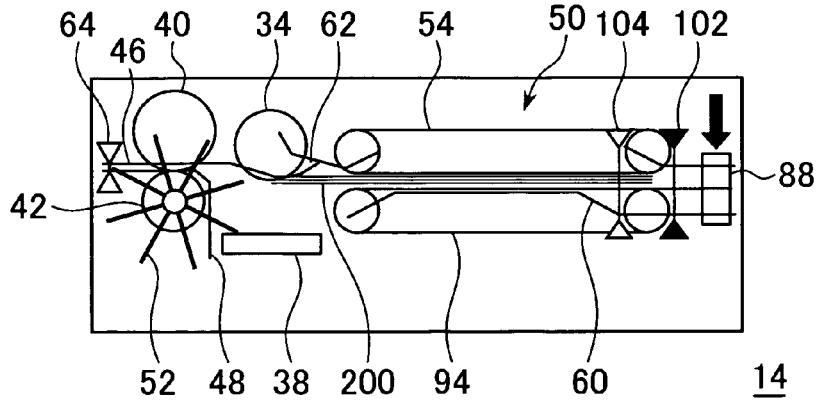

It is possible to sense with the sensor 102 that the bills 200 are drawn into the gateway 14. As shown in FIG. 34, whenever the rear ends of the bills 200 are sensed with the sensor 102, the controller 70 stops the accumulation belt motor 76 to cease the rotation of the accumulation belt 54 and the lump conveyor belt 94. Further, the controller 70 drives the shutter motor 90 to close the shutter 88, thus terminating the bill drawing operation (step S350).

Now, the separating operation for bills by the separation mechanism 30 in the gateway 14 will be described according to steps in the flowchart shown in FIG. 12, and FIGS. 35 to 38 which are side views of the gateway 14.

Figure 35:
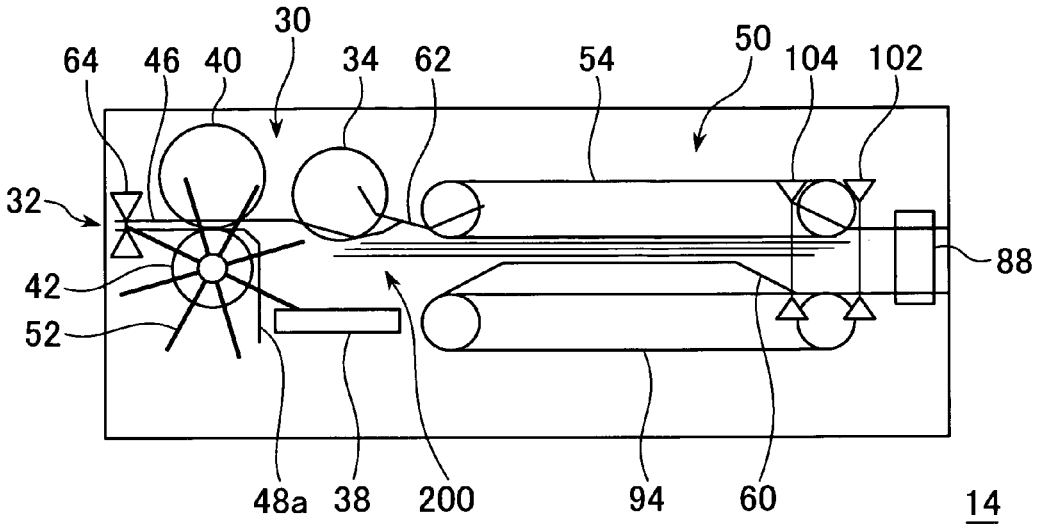
FIGS. 35 through 38 show in side views for illustrating the separating operation of the essential portion of the gateway shown in FIG. 1.

At the start of separating of the bills 200, the respective elements take their initial positions as shown in FIG. 35. More specifically, the impellers 38 are lifted in the state of being positioned on the side of the gate roller 42. The pressing plate 38 is lowered. Further, the accumulation belt 54 and the lump conveyor belt 94 are lowered as well. Further, the shutter 88 is closed. In addition, as shown in FIG. 35, the accumulated bills 200 are caught between the accumulation belt 54 and the sheet guides 60, and the leading ends of the bills 200 are not aligned.

Figure 36:
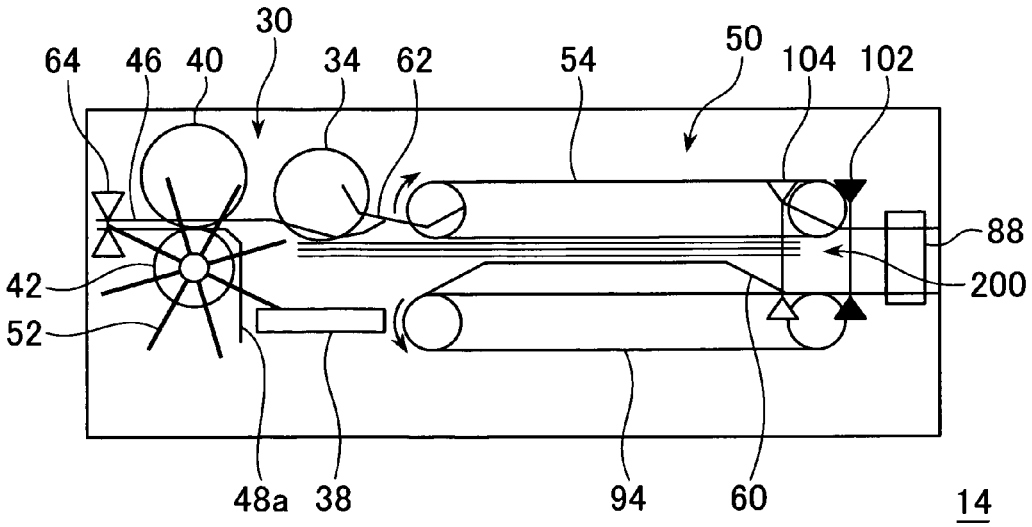

First, to describe the step of aligning the leading ends (step S110), the controller 70 drives the accumulation belt motor 76 to rotate the accumulation belt 54 in the clockwise direction shown by an arrow in FIG. 36, more specifically, in a direction in which the bills 200 are sent from the accumulation mechanism 50 toward the separation mechanism 30. When the accumulation belt 54 rotates in this way, the bills 200 strike against the wall 48*a* composing of a part of the sheet guide 48 in due course. After the elapse of a predetermined time elapses while the bills 20 abuts against the wall 48*a*, the accumulation belt motor 76 is stopped. By this operation, it is possible to align the leading ends of the accumulated bills 200 in an orderly manner.

Figure 37:
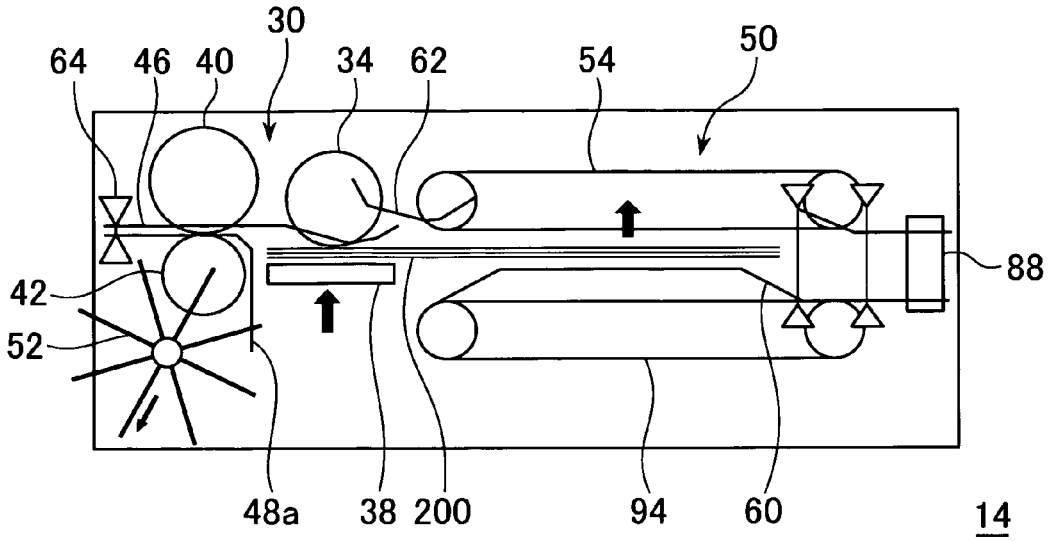
Figure 38:
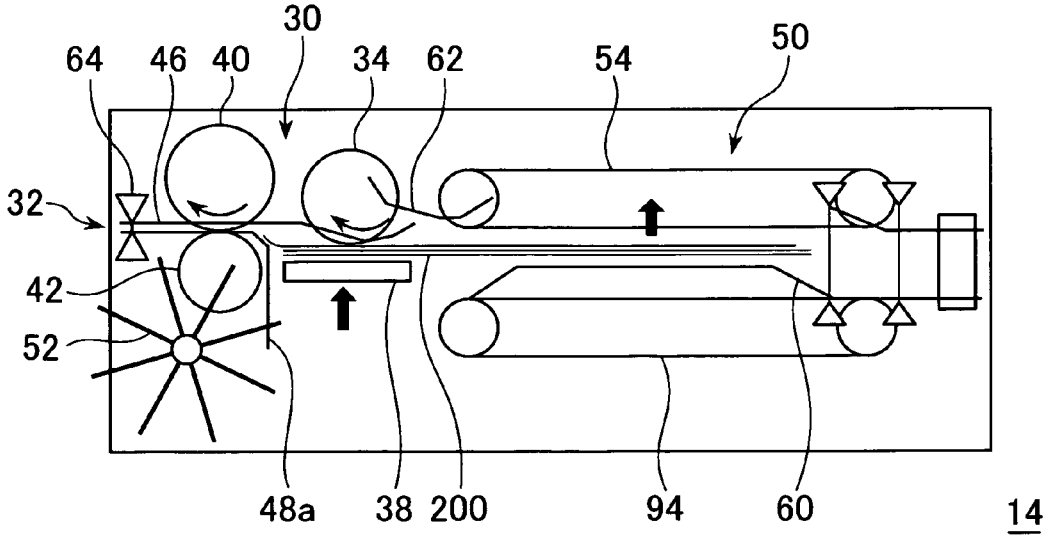

When the leading ends of the bills 200 are aligned, the controller 70 executes a separation preparing operation in step S120. The pressing motor 74 is driven, as shown in FIG. 37, to lower the impellers 52 so as not to interfere with the separation of the bills 200, and to lift the pressing plate 38 to press the leading ends of the accumulated bills 200 against the pickup roller 34. The pressing motor 74 is stopped with the bills 200 depressed against the pickup roller 34.

Further, the controller 70 drives the evacuating motor 78 to lift the accumulation belt 54. This lifting of the accumulation belt 54 is an operation of evacuating the accumulation belt 54 for the purpose of avoiding interference with the separating work for the bills 200 that will be performed in the following step. The impellers 52, the pressing plate 38 and the accumulation belt 54, when disposed in this way as shown in FIG. 37, are prepared for the separation preparation.

Figure 39:
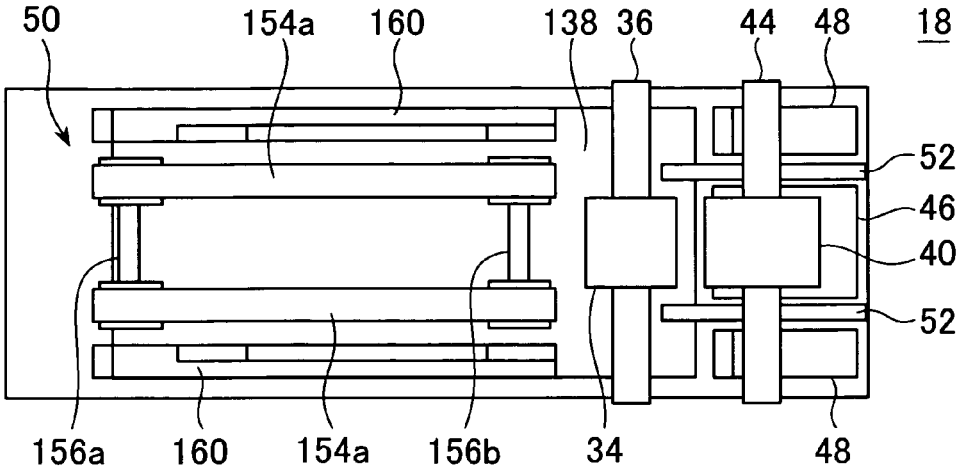
FIG. 39 shows in a top view the essential portion of the storage shown in FIG. 1.

When the impellers 52, the pressing plate 38 and the accumulation belt 54 take the positions for the separation preparation, the controller 70 drives the separation motor 72 to rotate the pickup roller 34 and the feed roller 40 in a direction for sending out a bill via the bill delivery slot 32 to the outside of the gateway 14, i.e. in the clockwise direction in FIG. 39.

When the pickup roller 34 and the feed roller 40 are rotated, the bills 200 pressed against the pickup roller 34 by the pressing plate 38 are separated from each other to be fed out in the direction of the bill delivery slot 32.

The configuration and operation as described above cause the discharge of accumulated bills to the customer interface 12, the drawing of the bills from the customer interface and the separation of accumulated bills are executed. Thus, the gateway 14, capable of accumulating bills more advantageously than the conventional art, can smoothly perform the discharge, drawing and separation of bills as well.

Next, the storage 18 (the storages 18*a* and 18*b*) will be described in which the separation mechanism 30 and the accumulation mechanism 50 are installed. First, the configuration thereof will be described with reference to FIGS. 39 to 41. It is to be noted that portions similar to the components employed to the gateway 14 and the temporary holder 16 are indicated by the same reference numerals. Further, those portions will not repetitively be described in order to avoid redundancy. As described above, the configuration of the feeder/retriever 22 may be similar to that of the storage 18. Therefore, the description of the storage 18 which will appear below is applicable to that of the feeder/retriever 22.

The components and preferable position of the separation mechanism 30 are similar to those in the embodiments of the gateway 14 and the temporary holder 16.

The storage 18 has a pressing plate 138 disposed so as to face the lower side of the pickup roller 34. The pressing plate 138 can store bills in a pile on its upper surface. The pressing plate 138 is configured to operate to be lifted and lowered by the driving machine such as the pressing motor 74, and the pressing plate mechanism 82 for lifting and lowering the pressing plate 138, the driving machine and the mechanism 82 not being shown in FIGS. 39 and 40. In the context, the pressing plate mechanism 82 means parts and members provided for lifting and lowering the pressing plate 138 by the driving force received from the motor 74, and includes the pressing plate 138 as one of its elements. Therefore, by lifting down the pressing plate 138 in accordance with the thickness of bills piled up, it is possible to store an arbitrary number of bills 200 on the pressing plate 138. Further, by lifting up the pressing plate 138, it is possible to press the bills 200 stored on the pressing plate 138 against the pickup roller 34. The configurational relationship in control aspect between the pressing plate 138, the pressing plate mechanism 82 and the pressing motor 74 will be described later in detail, and is shown in FIG. 41.

The accumulation mechanism 50 in the storage 18 has accumulation belts 154 serving as a bill conveyor, and transmission mechanisms 156*a* and 156*b* composed of pulleys, shafts and so on. The accumulation belts 154, which are rotated by the driving machine such as the accumulation belt motor 76, are endless belts formed of an elastic material such as rubber. The transmission mechanisms 156*a* and 156*b* are part of a belt mechanism 84*c* (refer to FIG. 41) for rotating the accumulation belts 154. The accumulation belts 154 receive the driving force transmitted via the transmission mechanisms 156*a* and 156*b* from the driving machine such as the accumulation belt motor 76, not shown in FIGS. 39 and 40, to be rotated in a predetermined direction. The configurational relationship in control aspect between the accumulation belts 154, the belt mechanism 84*c* and the accumulation belt motor 76 is shown as well in FIG. 41.

The accumulation belts 154 in the present embodiment are formed by a pair of belts 154*a* and 154*b*, each of which is disposed so as to touch the vicinity of the middle part in the conveying direction of bills. The accumulation belts 154*a* and 154*b* receive the driving force from the transmission mechanisms 156*a* and 156*b* to make a synchronous rotary movement, thereby causing the bills touching the accumulation belts 154 to be conveyed in the direction of the force applied to the touching part.

The accumulation mechanism 50 has sheet guides 160 serving as guide members. The sheet guides 160 are adapted to regulate both ends of a bill sent by the separation mechanism 30 and then smoothly guide the bill into the storage 18.

The sheet guides 160 are, in order to enable a sent bill to be guided with its both ends regulated, disposed along the opposite lateral sides in the storage 18, more specifically, in the direction and outer vicinity of the accumulation belts 154*a* and 154*b* horizontally extending. Further, the accumulation belts 154 and the sheet guides 160 are disposed one above the other in the vertical direction to render a bill guided by the sheet guides 160 touch the accumulation belts 154.

Each of the sheet guides 160 has its tip portion, opposing the separation mechanism 30, forming a receiver 160*a* inclined downward to smoothly guide a bill, sent from the separation mechanism 30, to between the sheet guides 160 and the accumulation belts 154 in series.

Figure 40:
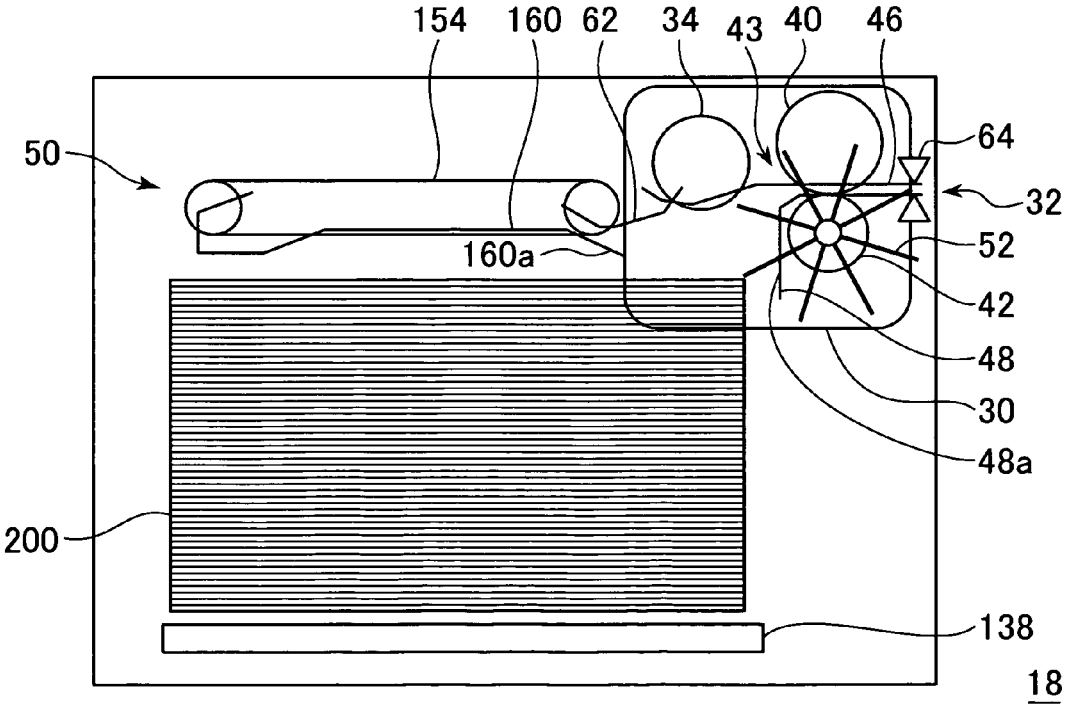
FIG. 40 shows in a side view the essential portion of the storage shown in FIG. 1.
Figure 41:
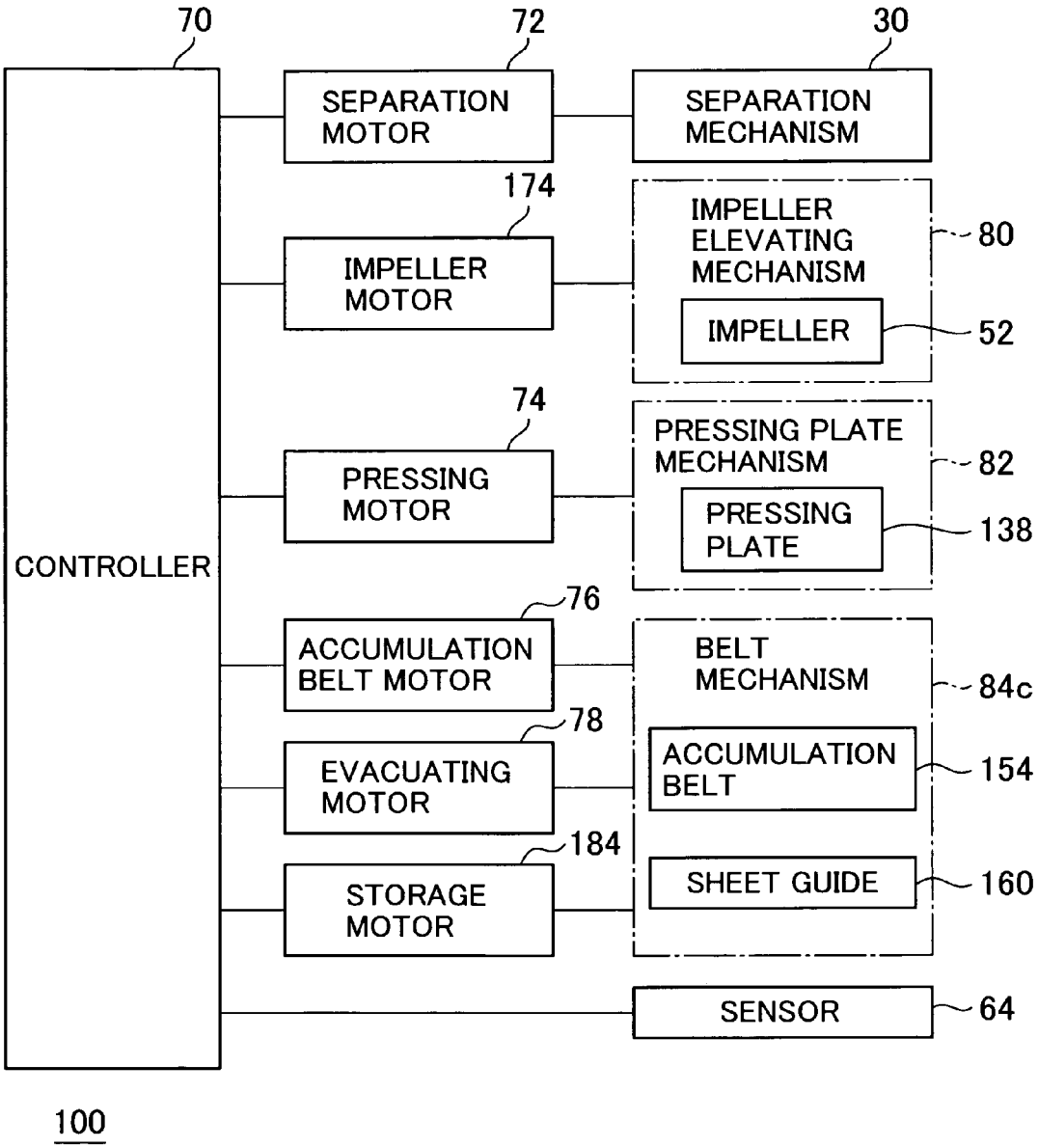
FIG. 41 is a block diagram showing the configuration of a control system of the storage shown in FIG. 1.

Therefore, when the accumulation belts 154 are rotated in the clockwise direction in FIG. 40, the accumulation belts 154 touch a bill guided by the sheet guides 160 to catch the sent bill in series against the sheet guides 160 to convey the bill. In this way, the accumulation belts 154 accumulate conveyed bills on the sheet guides 160.

Further, the sheet guides 160 are moved to be lifted and lowered by a driving machine such as a storage motor 184, not shown in FIGS. 39 and 40. This lifting and lowering movement makes it possible to store the bills, accumulated between the sheet guides and the accumulation belts 154, onto the pressing plate 138.

Next, the configuration in control aspect between the separation mechanism 30 and the accumulation mechanism 50 in the storage 18 will be described with reference to FIG. 41.

The controller 70 with which the bill processor 10 is equipped is responsive to control programs, or software, stored in the memory, not shown, to control the entire storage 18 by means of the separation motor 72, an impeller motor 174, the pressing motor 74, the accumulation belt motor 76, the evacuating motor 78, the storage motor 184, the sensor 64 and so on. That forms the control mechanism 100 for controlling various operations of the storage 18.

The relationship of the separation motor 72 for controlling the operation of the separation mechanism 30 and the sensor 64 with respect to the controller 70 is similar to the embodiment of the configuration in control aspect shown in FIG. 4.

The impellers 52 serving as components of the impeller elevating mechanism 80 are operated to be lifted and lowered by an impeller elevating driving machine such as the impeller motor 174 controlled by the controller 70. Further, the pressing plate 138 serving as a component of the pressing plate mechanism 82 is operated to be lifted and lowered by the pressing motor 74 controlled by the controller 70. In the storage 18 according to the present embodiment, different from the embodiments of the temporary holder 16 and the gateway 14, the impeller motor 174 for lifting and lowering the impellers 52 and the pressing motor 74 for lifting and lowering the pressing plate 138 are arranged independently from each other. However, this does not intend to inhibit the lifting and lowering operation entirely relying upon a single motor as in the embodiments of the temporary holder 16 and the gateway 14. It goes without saying that a configuration may be adopted in which the temporary holder 16 and the gateway 14 are respectively provided with a motor for use in lifting and lowering the impellers and a motor for use in lifting and lowering the pressing plate.

In the storage 18 according to the present embodiment, the accumulation belts 154 are components of the belt mechanism (accumulation/guide mechanism) 84*c* running for accumulating and guiding bills. The accumulation belts 154 are operated to rotate by the accumulation belt motor 76, and be lifted and lowered by the evacuating motor 78. The sheet guides 160 as well are components of the belt mechanism 84*c* running for storing bills in addition to the accumulation and guiding of bills, and operated to be lifted and lowered by a guide member driving machine such as the storage motor 184.

The sensor 64 senses the reception and discharge of bills under the control of the controller 70.

Next, the accumulating operation of the storage 18 of this configuration will be described with reference to the flowchart showing the accumulating operation of FIG. 5, and FIGS. 42 to 47 which are side views of the storage 18. In addition, the accumulating operation performed by the storage 18 means an operation executed at the preceding stage of the storage operation for eventually placing and storing bills on the pressing plate 138 which is a predetermined storage place in the storage 18, that is, an operation for provisionally put together bills sent from the outside.

Figure 42:
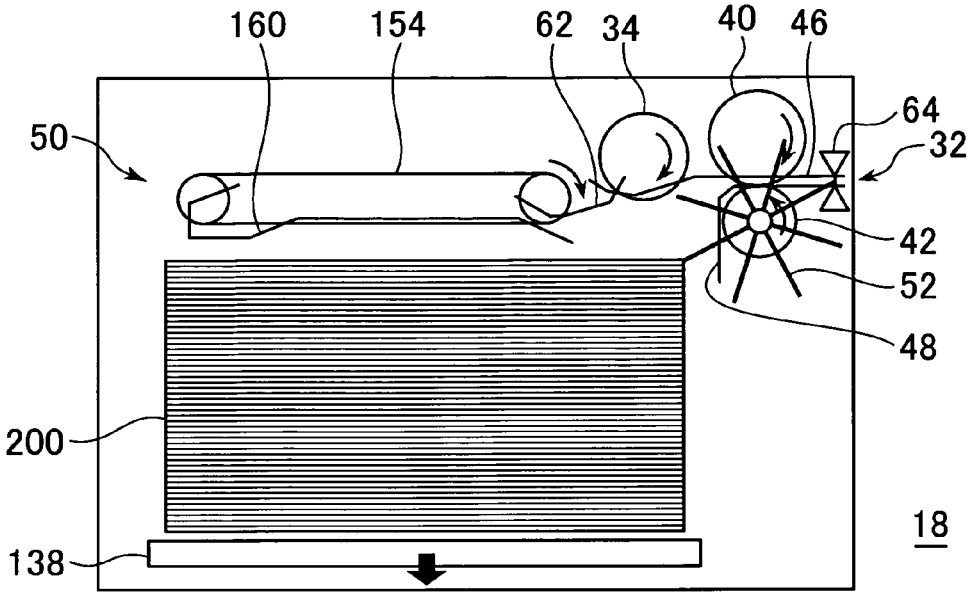
FIGS. 42 through 47 are side views for illustrating the accumulating operation of the essential portion of the storage shown in FIG. 1.

First, as shown in step S10 in FIG. 5 and in FIG. 42, the controller 70 controls the respective devices so as to cause the storage 18 to prepare to accumulate bills. In detail, the impeller motor 174 is controlled to lift the impellers 52, and the pressing motor 74 is controlled to lower the pressing plate 138. The pressing plate 138 is adjusted in height so that the uppermost one of the bills 200 stored on the pressing plate 138 comes close in height to the sheet guides 160. Further, the controller 70 controls the evacuating motor 178 to lower the accumulation belts 154 and the storage motor 184 to lower the sheet guides 160. By this operational control, the impellers 52, the pressing plate 138, the accumulation belts 154 and the sheet guides 160 are disposed at the accumulation preparing positions thereof as shown in FIG. 42.

After completion of the disposition of those elements at the accumulation preparing positions, the controller 70 drives the separation motor 72. That causes the pickup roller 34, the feed roller 40, the gate roller 42 and the impellers 52 to rotate so as to enable a bill sent to the bill delivery slot 32 to be drawn. Further, the controller 70 drives the accumulation belt motor 76 to rotate the accumulation belts 154 so as to cause the bill sent from the separation mechanism 30 to be drawn. The rotational direction is specifically shown by an arrow in FIG. 42.

Figure 43:
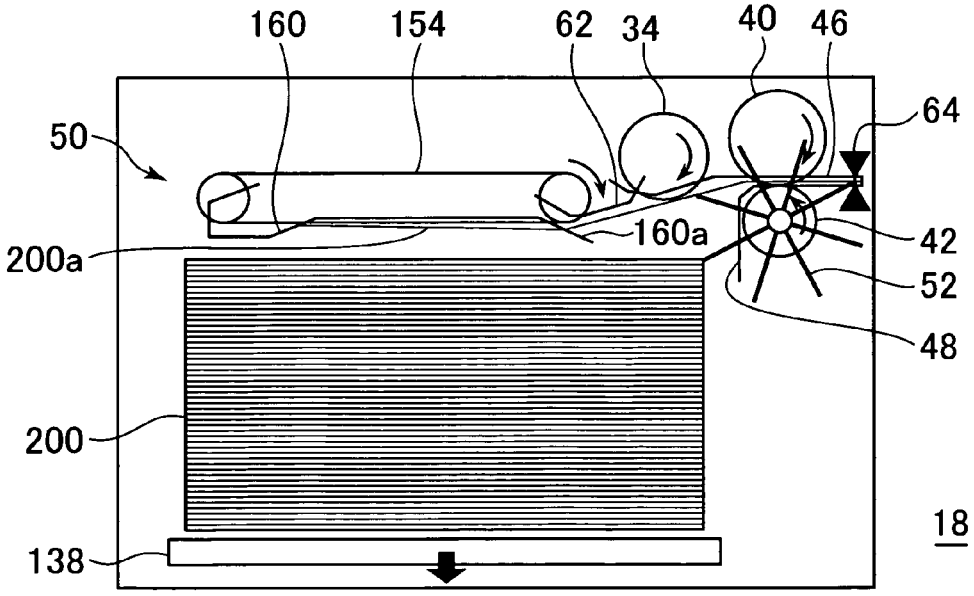

Next, the control proceeds to a bill leading end drawing operation shown in step S20 in FIG. 5. The situation of this step is shown in FIG. 43. The leading end of the first bill 200*a* delivered through the conveyance channel 20 via the bill delivery slot 32 into the storage 18 is sensed by the sensor 64. The bill 200*a* is then sent into the separation mechanism 30 by means of the pickup roller 34, the feed roller 40, the gate roller 42 and the impellers 52 rotating. Further, the leading end of the bill 200*a* is guided by the sheet guides 62 and the receivers 160*a* to enter between the accumulation belts 154 and the sheet guides 160. The bill 200*a* entering between the accumulation belts 154 and the sheet guides 160 touches the accumulation belts 154 to be drawn into the accumulation mechanism 50 by the rotational force received from the accumulation belts 154.

Figure 44:
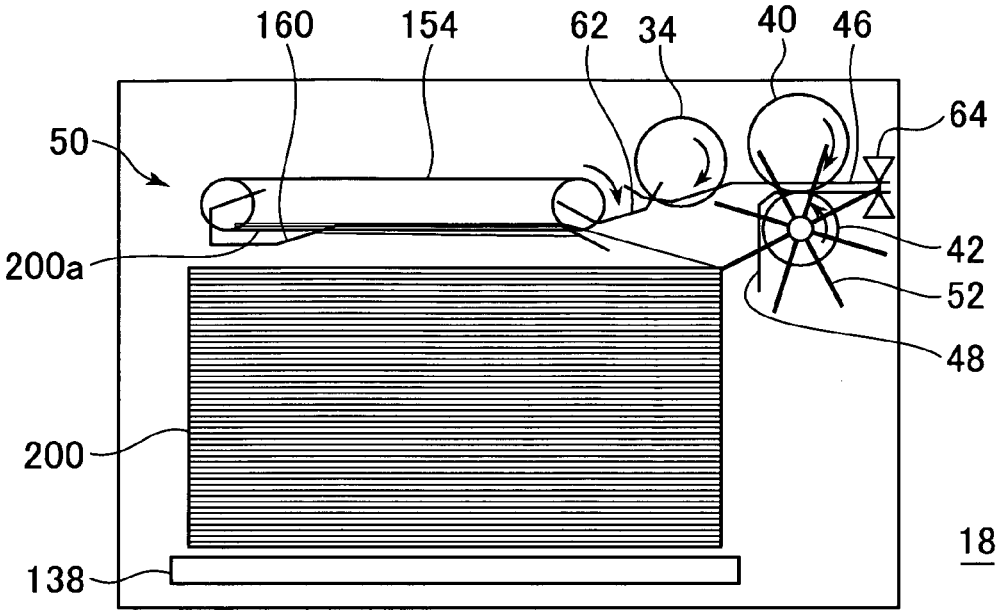
Figure 45:
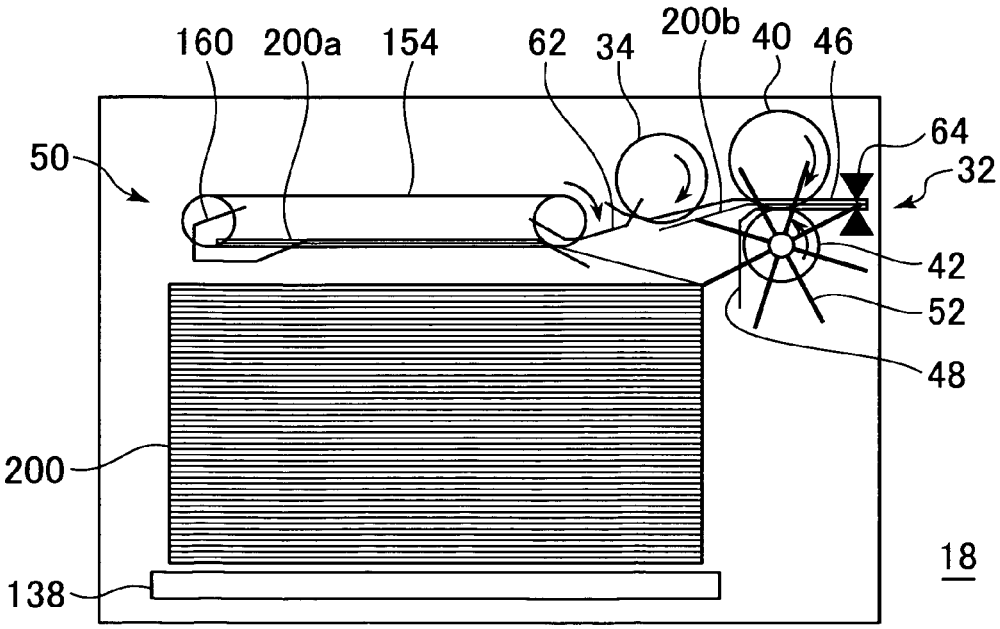

When the rear end of the bill 200*a* is sensed by the sensor 64, the controller 70 executes the bill accumulation finishing operation shown in step S30 in FIG. 5. More specifically, upon a receipt of the rear end of the bill 200*a* being sensed by the sensor 64, the rear end of the bill 200*a* is completely drawn into the storage 18, and thereafter, upon the predetermined time elapsing for drawing the bill 200*a* to the position at which it is possible to slap down the rear end of the bill 200*a* by the impellers 52, the accumulation belt motor 76 is stopped, causing the rotation of the accumulation belt 54 to stop, thus terminating the accumulation of the first bill 200*a*, as shown in FIG. 44.

When the succeeding bill 200*b* is sent from the outside of the storage 18 and the leading end of the bill 200*b* is then sensed by the sensor 64, the controller 70 executes an accumulation belt drive operation in step S40. If the leading end of the bill 200*b* is sensed, upon an elapse of a predetermined time for drawing the bill 200*b* to a position at which it is possible to guide the leading end of the bill 200*b* by the sheet guides 62, the accumulation belt motor 76 is driven to rotate the accumulation belts 154 in a direction in which a bill is drawn into the accumulation mechanism 50, i.e. in the clockwise direction in FIG. 45.

Figure 46:
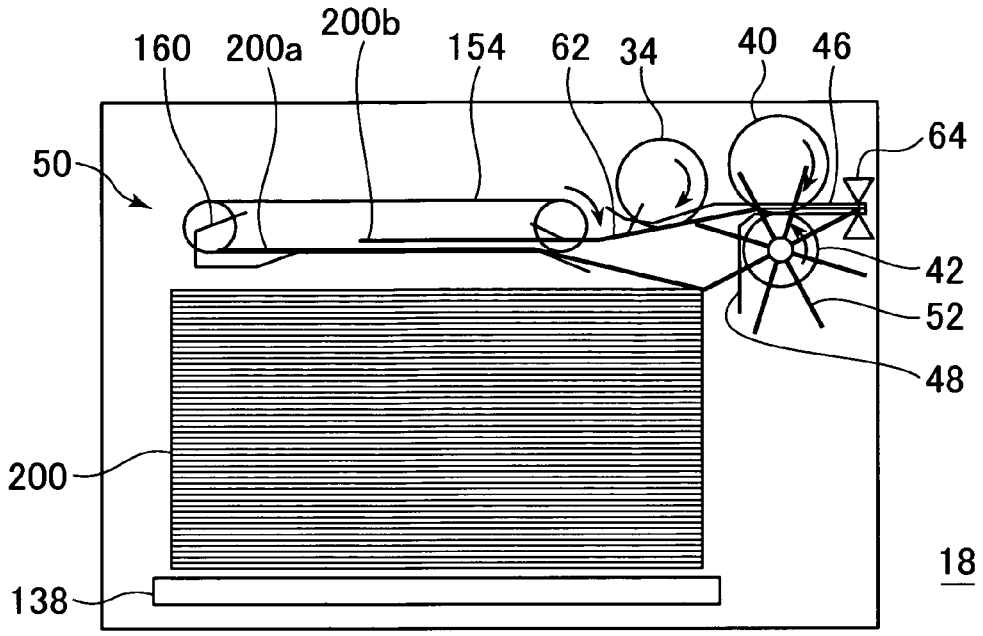

Then, the controller 70 executes the bill leading end drawing operation shown in step S50. When the accumulation belts 154 are rotated, as shown in FIG. 46, the leading end of the bill 200*b* is guided by the sheet guides 160 to enter between the accumulation belts 154 and the sheet guides 160. The bill 200*b* entering between the accumulation belts 154 and the sheet guides 160 is caught by the accumulation belts 154 and the sheet guides 160 to be drawn into the accumulation mechanism 50 by the force received from the rotational operation of the accumulation belts 154.

Figure 47:
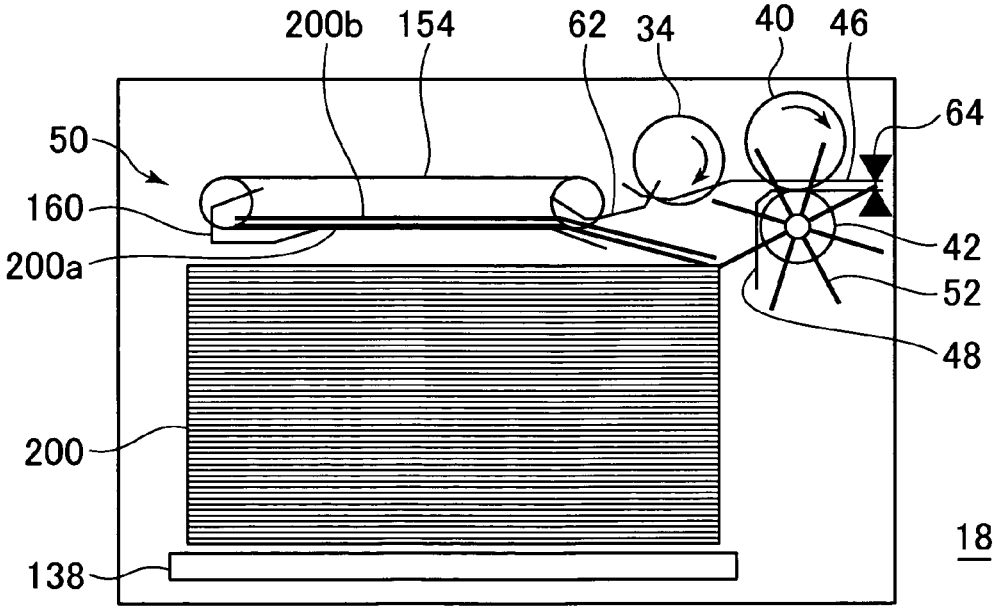

When the rear end of the bill 200*b* is sensed by the sensor 64, the controller 70 executes the bill accumulation finishing operation of step S60, as shown in FIG. 47. More specifically, when the rear end of the bill 200*b* is sensed, the rear end of the bill 200*b* is completely drawn into the storage 18, and thereafter, upon the predetermined time elapsing for drawing the bill 200*b* to a position at which it is possible to slap down the rear end of the bill 200*b* by the impellers 52, the accumulation belt motor 76 is stopped, thus stopping the rotation of the accumulation belts 154. The accumulation of the bill 200*b* thus terminates.

When the accumulation of the bill 200*b* is terminated, the controller 70 determines whether or not all the bills to be accumulated have been piled up (step S70). When it is determined that there are succeeding bills to be accumulated, the control returns to the processing in step S40 to continue the accumulating operation for the succeeding bills. On the contrary, when it is determined that there is no succeeding bill, the controller 70 stops the separation motor 72 to cause the pickup roller 34, the feed roller 40, the gate roller 42 and the impellers 52 to stop rotating, thus terminating the accumulating operation.

Since the bills are accumulated by such configuration and operation, a time required for preparation to accumulate bills conveyed from the conveyance section 20 is only a short period from the start of the accumulation belt motor 76 till the speed of the accumulation belts 154 becoming stable. Accordingly, it is possible to shorten an interval between bills to be conveyed, thus making it possible to shorten a processing time for counting bills.

Further, the leading end of a bill sent into the storage 18 is guided by the sheet guides 62 to enter between the accumulation belts 154 and the sheet guides 160. The bill is then caught by the accumulation belts 154 and the sheet guides 160 to be accumulated in the storage 18. That effectively makes it possible to shorten a time for the preparing operation to accumulate bills, and hence to shorten a time for the bill accumulating operation.

Moreover, since a bill sent from the outside of the storage 18 is caught by the accumulation belts 154 and the sheet guides 160 to be drawn into the storage 18, it is possible to attain the advantage that there is no risk of causing mechanical malfunction such as bill jamming otherwise occurring due to the bill knocking the pressing plate 138 and the bills 200 accumulated on the pressing plate 138. The above respective advantages may be attained also with the feeder/retriever 22 having the configuration similar to the storage 18 as described above.

Figure 48:
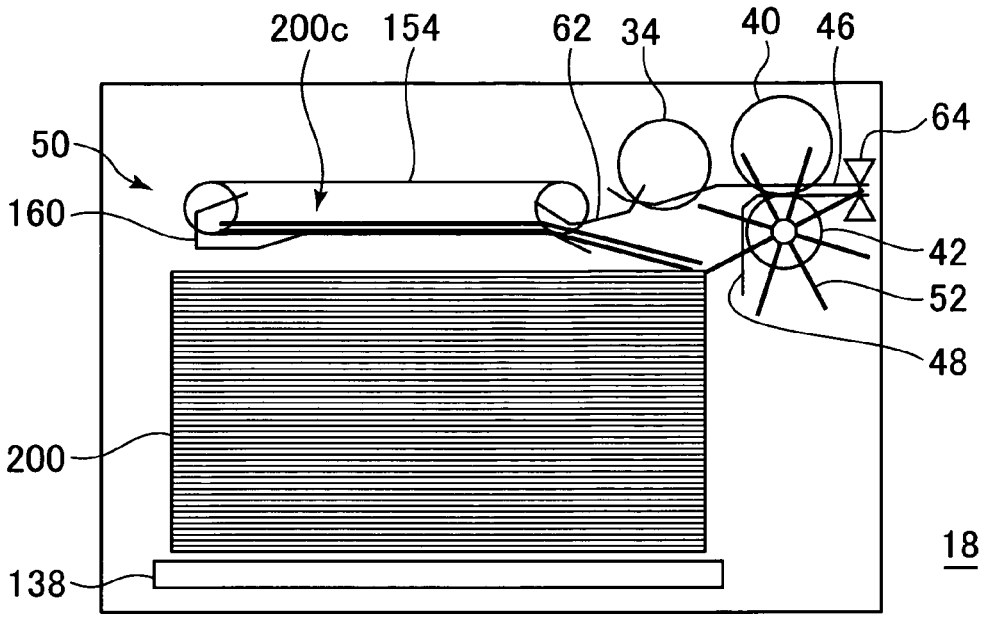
FIGS. 48 through 53 are explanatory diagrams showing the storage operation of the essential portion of the storage shown in FIG. 1.
Figure 50:
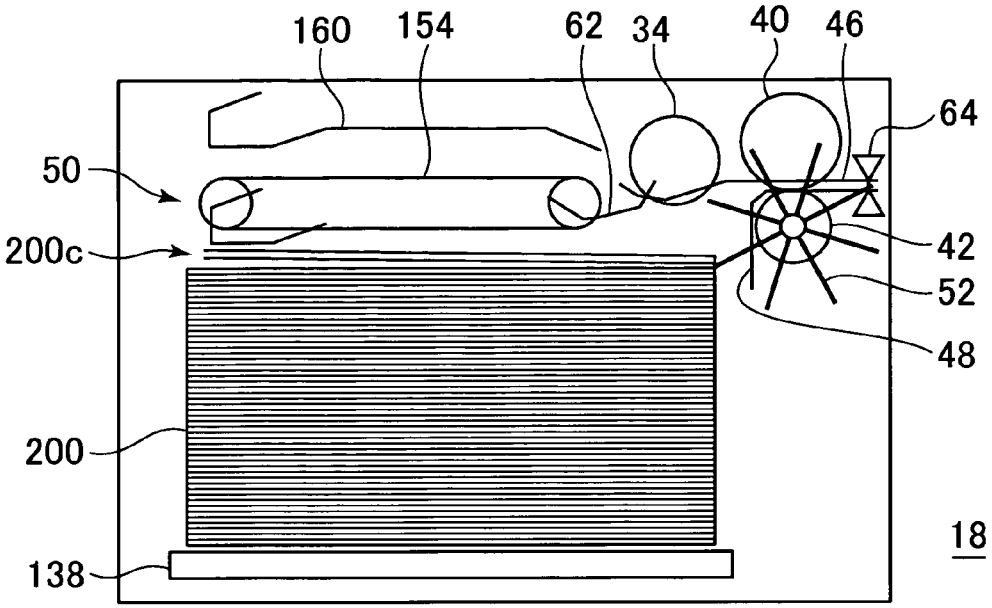
Figure 51:
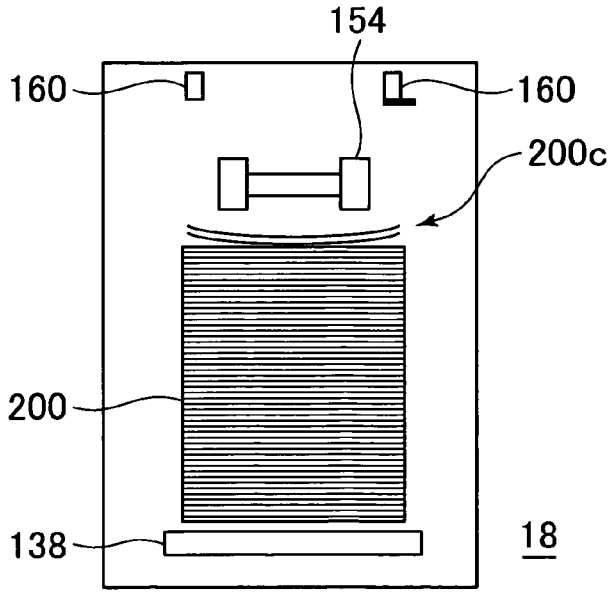
Figure 52:
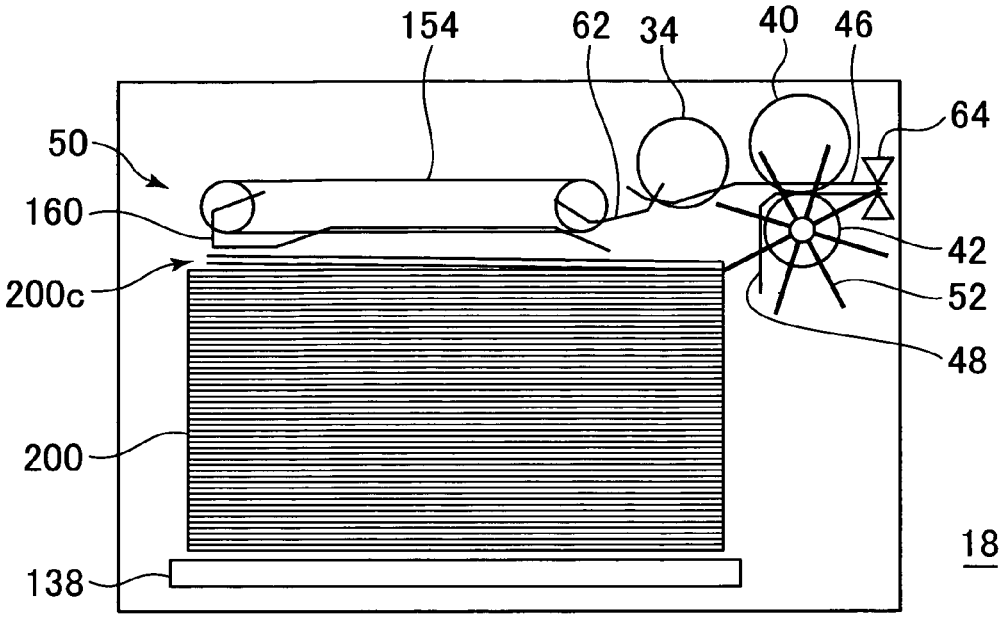

Next, the operation of further storing accumulated bills by the storage 18 will be described with reference to FIGS. 48 to 53. FIGS. 48, 50, and 52 are side views of the storage 18 during the storage operation, which proceeds in the order of FIGS. 48, 50 and 52 on time series. Further, FIGS. 49, 51 and 53 are front views of the storage 18 respectively corresponding to the states of FIGS. 48, 50 and 52.

Figure 49:
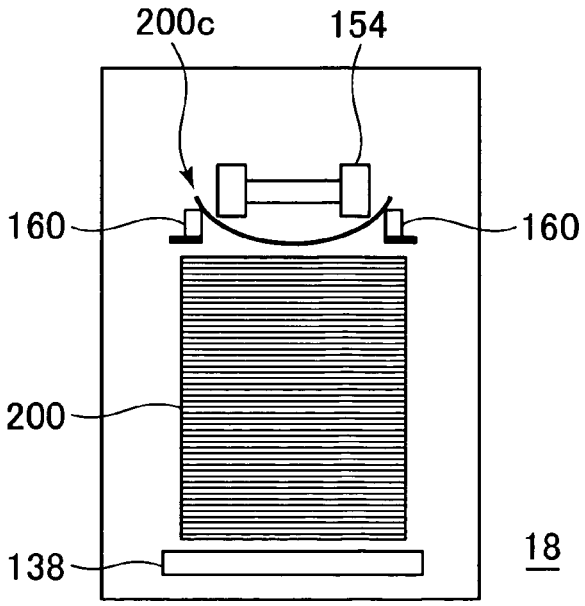

The state of the storage 18 when all the bills have been piled up is shown in FIGS. 48 and 49, which are the side and front views of the storage 18, respectively. More specifically, the impellers 52 are lifted. The pressing plate 138 is disposed at a height at which the top surface of the bills 200 stored on the pressing plate 138 comes close to the sheet guides 160. Further, the accumulation belts 154 and the sheet guides 160 both are lowered, and catch and accumulate several bills 200*c*.

The controller 70 drives the storage motor 184, see FIG. 41, to lift the sheet guides 160 to in turn cause the degree of curve of the bills 200*c* accumulated between the accumulation belts 154 and the sheet guides 160 to increase. When the sheet guides 160 are further lifted, the bills 200*c* are further curved such that both ends thereof get substantially upright to slip through between the accumulation belts 154 and the sheet guides 160. As a result, as shown in FIG. 50 and FIG. 51 that corresponds to this situation, the bills 200*c* drop on the bills 200 already stored on the pressing plate 138.

Figure 53:
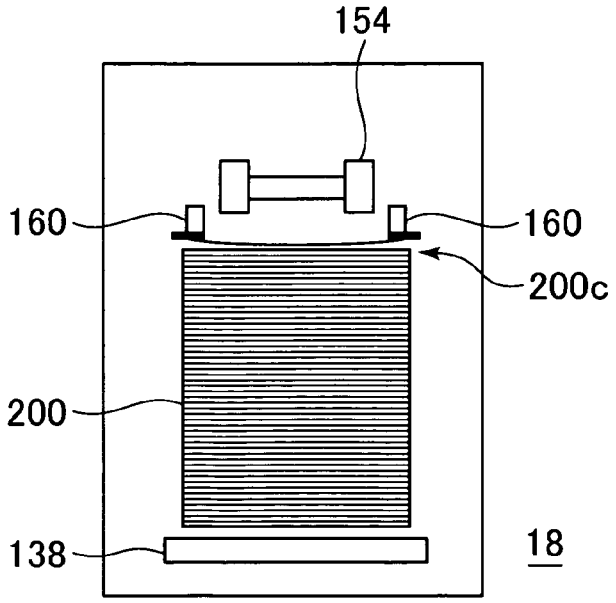

Thereafter, the controller 70 lowers the sheet guides 160 as shown in FIG. 52, the side view, and in FIG. 53, the front view at that time. The bills 200*c* are pressed onto the bills 200 already stored on the pressing plate 138 by the lowered sheet guides 160. In this way, the bills 200*c* accumulated between the accumulation belts 154 and the sheet guides 160 are stored as part of the pile of bills 200 already stored on the pressing plate 138.

When the bills 200*c* are stored on the bills 200 already piled on the pressing plate 138, the controller 70 lowers the pressing plate 138. That is, the pressing plate 138 moves to the height at which the top surface of the bills 200*c*, which has newly become the uppermost bill among the bills piled on the pressing plate 138, is located near the sheet guides 160. Thus, the storage operation by the storage 18 has been described above from beginning to end.

Next, the separating operation for bills by the separation mechanism 30 in the storage 18 will be described with reference to FIG. 54 which is a side view of the storage 18.

In the initial state, as shown in FIG. 40, the impellers 52 are lifted up to the gate roller 42 on the opposite sides thereof. The pressing plate 138 is set at a height at which the top surface of the pile of bills 200 stored on the pressing plate 138 is positioned near the sheet guides 160. Further, the accumulation belts 154 and the sheet guides 160 are lowered.

Figure 54:
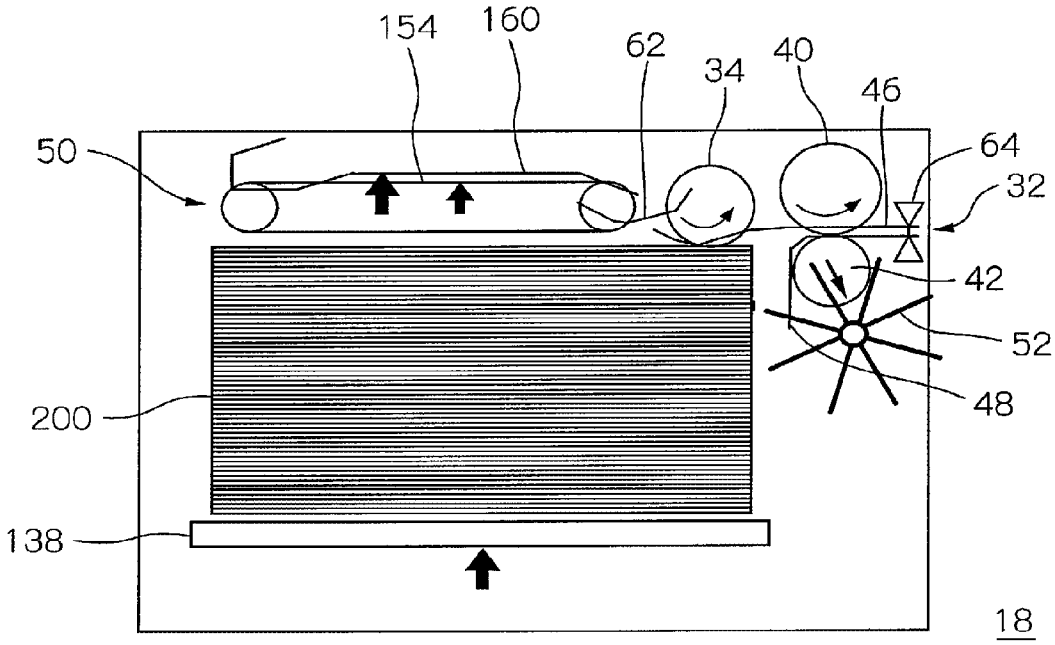
FIG. 54 is a side view for illustrating the separating operation of the essential portion of the storage shown in FIG. 1.

As shown in FIG. 54, the controller 70 drives the impeller motor 174, not shown in this figure, to lower the impellers 52 so as not to interfere with the separating operation of the bills 200. Further, the accumulation belts 154 are lifted by the evacuating motor 78. Further, the storage motor 184 is driven to lift the sheet guides 160. The controller 70 drives the pressing motor 74 to lift the pressing plate 138. The leading ends on the separation mechanism side of the bills 200 accumulated on the pressing plate 138 are pressed against the pickup roller 34 when the pressing plate 138 is lifted. After the bills 200 are pressed against the pickup roller 34, the controller 70 stops the lifting of the pressing plate 138.

When the impellers 52, the pressing plate 138, the accumulation belts 154 and the sheet guides 160 take the separation preparing positions in this way, the controller 70 drives the separation motor 72 to rotate the pickup roller 34 and the feed roller 40 so as to feed out the bills in the direction of the bill delivery slot 32.

When the pickup roller 34 and the feed roller 40 rotates, the bills 200 pressed against the pickup roller 34 by the pressing plate 138 are separated from each other, and further pass through the bill delivery slot 32 to be fed out to the outside of the storage 18.

Since the storage of accumulated bills and the separation of stored bills are executed by the configuration and operation as described above, the storage 18, capable of accumulating bills more advantageously than the conventional art, can also smoothly storing bills accumulated in the storage and separate the stored bills. Such is the case with the feeder/retriever 22 having the configuration similar to that of the storage 18.

The bill processor 10 has the gateway 14, the temporary holder 16, and the storage 18 in which arranged are the separation mechanisms 30 and the accumulation mechanisms 50 described in connection with the above embodiments, thereby shortening a time for the bill accumulating operation and preventing mechanical malfunction such as bill jamming from occurring. However, the bill processor 10 is preferably, but not necessarily, equipped with all the processing units according to the above-described embodiments. For example, the processing units in which the separation mechanisms 30 and the accumulation mechanisms 50 are arranged may be equipped with only one or two of the gateway 14, the temporary holder 16 and the storage 18 with the remaining processing units provided with conventional mechanisms. Even in that case, it is possible to shorten at least a bill processing time in the processing units which includes the separation mechanism 30 and the accumulation mechanism 50, and further to prevent mechanical malfunction from being caused in those processing units.

The entire disclosure of Japanese patent application No. 2008-210101 filed on Aug. 18, 2008, including the specification, claims, accompanying drawings and abstract of the disclosure, is incorporated herein by reference in its entirety.

While the present invention has been described with reference to the particular illustrative embodiments, the invention is not to be restricted by the embodiments. It is to be appreciated that those skilled in the art can change and modify the embodiments without departing from the scope and idea of the present invention.

The invention claimed is:

1. A media processor, comprising:

a conveyance channel over which a paper sheet-like medium is conveyed;

at least one accumulation mechanism that accumulates the medium sent from the conveyance channel, the accumulation mechanism including a first guide member that guides the sent medium so as to accumulate the sent medium thereon, and a conveyor that is disposed adjacent to the first guide member so as to convey the sent medium onto the first guide member, the sent medium being caught between the conveyor and the first guide member;

at least one separation mechanism connected to the conveyance channel for separating the media accumulated on the accumulation mechanism to send the media in series to the conveyance channel; and a conveyor driving machine that moves the conveyor to a predetermined position so as to ensure a movement separation of the media when the media are separated by the separation mechanism;

wherein the first guide member is disposed on both sides of the conveyor;

wherein the conveyor is an accumulation belt; and wherein the first guide member includes a receiver configured to smoothly guide a bill.

2. The media processor according to claim 1, further comprising:

a temporary holder that temporarily reserves the medium inserted from an outside of the media processor, wherein the separation mechanism and the accumulation mechanism are included in the temporary holder, the accumulation mechanism being connected to the separation mechanism.

3. The media processor according to claim 1, further comprising:

a gateway that receives one or more sheets of the media input from an outside of the media processor, and sends the media individually to the conveyance channel, wherein the separation mechanism and the accumulation mechanism are included in the gateway, the accumulation mechanism being connected to the separation mechanism.

4. The media processor according to claim 3, further comprising:

a customer interface that communicates with the gateway for performing reception and delivery of the medium with respect to a user, wherein the accumulation mechanism includes a lump conveyor that is arranged so as to face the conveyor to press the medium toward the conveyor to convey the medium, one or more sheets of the media accumulated on the first guide member being caught between the lump conveyor and the conveyor to be conveyed to the customer interface.

5. The media processor according to claim 4, further comprising:

a lump conveyor driving machine that moves the lump conveyor when the conveyor and the lump conveyor catch or release the medium.

6. The media processor according to claim 1, further comprising:

a storage in which the medium accumulated on the accumulation mechanism is stored in position.

7. The media processor according to claim 6, wherein the separation mechanism and the accumulation mechanism are included in the storage, the accumulation mechanism being connected to the separation mechanism.

8. The media processor according to claim 7, further comprising:

a guide member driving machine that moves the first guide member, wherein in the storage, the first guide member is arranged outside on opposite sides of the conveyor, and the guide member driving machine lifts the first guide member when the medium accumulated on the first guide members is stored in position.

9. The media processor according to claim 6, further comprising:

a feeder/retriever that feeds the medium for supplementary to the storage and stores the medium retrieved from the storage, wherein the separation mechanism and the accumulation mechanism are included in the feeder/retriever, the accumulation mechanism being connected to the separation mechanism.

10. The media processor according to claim 9, further comprising:

a guide member driving machine that moves the first guide member, wherein in the feeder/retriever, the first guide member is arranged outside on opposite sides of the conveyor, and the guide member driving machine lifts the first guide member when the medium accumulated on the first guide member is stored in position.

11. The media processor according to claim 1, further comprising:

at least one processing unit for processing the medium, selected from among a temporary holder that temporarily holds the medium inserted from an outside of the media processor;

a gateway that receives one or more sheets of the media input from the outside of the media processor and sends the media individually to the conveyance channel; and a storage that stores the medium therein, wherein the separation mechanism and the accumulation mechanism are included in the at least one processing unit, the accumulation mechanism being connected to the separation mechanism.

12. The media processor according to claim 11, further comprising:

a feeder/retriever that feeds the medium for supplementary to the storage and stores the medium retrieved from the storage, wherein the separation mechanism and the accumulation mechanism are included in the feeder/retriever, the accumulation mechanism being connected to the separation mechanism.

13. A media processor, comprising:

a conveyance channel over which a paper sheet-like medium is conveyed; and at least one accumulation mechanism that accumulates the medium sent from the conveyance channel, the accumulation mechanism including a first guide member that guides the sent medium so as to accumulate the sent medium thereon, and a conveyor that is disposed adjacent to the first guide member so as to convey the sent medium onto the first guide member, the sent medium being caught between the conveyor and the first guide member;

wherein the first guide member is disposed on both sides of the conveyor;

the media processor further comprising:

at least one separation mechanism connected to the conveyance channel for separating the media accumulated on the accumulation mechanism to send the media in series to the conveyance channel;

a conveyor driving machine that moves the conveyor to a predetermined position so as to ensure a movement separation of the media when the media are separated by the separation mechanism; and a temporary holder that temporarily reserves the medium inserted from an outside of the media processor;

wherein the separation mechanism and the accumulation mechanism are included in the temporary holder, the accumulation mechanism being connected to the separation mechanism; and wherein the accumulation mechanism includes an impeller that slaps down the medium sent from the separation mechanism to the accumulation mechanism, a second guide member that guides the medium sent from the separation mechanism to the accumulation mechanism between the conveyor and the first guide member, and a sensor that senses the medium sent into the accumulation mechanism, the separation mechanism including a pickup roller that feeds the accumulated medium in a direction of the conveyance channel, a separating gate that separates the media fed by the pickup roller to send the media to the conveyance section, a third guide member that guides the media sent from the separating gate to the conveyance channel, and a pressing plate that presses the accumulated media toward the pickup roller.

14. A media processor, comprising:

a conveyance channel over which a paper sheet-like medium is conveyed; and at least one accumulation mechanism that accumulates the medium sent from the conveyance channel, the accumulation mechanism including a first guide member that guides the sent medium so as to accumulate the sent medium thereon, and a conveyor that is disposed adjacent to the first guide member so as to convey the sent medium onto the first guide member, the sent medium being caught between the conveyor and the first guide member;

wherein the first guide member is disposed on both sides of the conveyor;

the media processor further comprising:

at least one separation mechanism connected to the conveyance channel for separating the media accumulated on the accumulation mechanism to send the media in series to the conveyance channel;

a conveyor driving machine that moves the conveyor to a predetermined position so as to ensure a movement separation of the media when the media are separated by the separation mechanism; and a gateway that receives one or more sheets of the media input from an outside of the media processor, and sends the media individually to the conveyance channel;

wherein the separation mechanism and the accumulation mechanism are included in the gateway, the accumulation mechanism being connected to the separation mechanism;

the media processor further comprising a customer interface that communicates with the gateway for performing reception and delivery of the medium with respect to a user;

wherein the accumulation mechanism includes a lump conveyor that is arranged so as to face the conveyor to press the medium toward the conveyor to convey the medium, one or more sheets of the media accumulated on the first guide member being caught between the lump conveyor and the conveyor to be conveyed to the customer interface; and wherein when the medium is inserted into the customer interface, the lump conveyor is lifted by the lump conveyor driving machine, and presses the inserted medium toward the conveyor to convey the medium into the gateway.

15. A media processor, comprising:

a conveyance channel over which a paper sheet-like medium is conveyed; and at least one accumulation mechanism that accumulates the medium sent from the conveyance channel, the accumulation mechanism including a first guide member that guides the sent medium so as to accumulate the sent medium thereon, and a conveyor that is disposed adjacent to the first guide member so as to convey the sent medium onto the first guide member, the sent medium being caught between the conveyor and the first guide member;

wherein the first guide member is disposed on both sides of the conveyor;

the media processor further comprising:

at least one separation mechanism connected to the conveyance channel for separating the media accumulated on the accumulation mechanism to send the media in series to the conveyance channel;

a conveyor driving machine that moves the conveyor to a predetermined position so as to ensure a movement separation of the media when the media are separated by the separation mechanism;

a gateway that receives one or more sheets of the media input from an outside of the media processor, and sends the media individually to the conveyance channel;

wherein the separation mechanism and the accumulation mechanism are included in the gateway, the accumulation mechanism being connected to the separation mechanism;

the media processor further comprising a customer interface that communicates with the gateway for performing reception and delivery of the medium with respect to a user;

wherein the accumulation mechanism includes a lump conveyor that is arranged so as to face the conveyor to press the medium toward the conveyor to convey the medium, one or more sheets of the media accumulated on the first guide member being caught between the lump conveyor and the conveyor to be conveyed to the customer interface;

the media processor further comprising a lump conveyor driving machine that moves the lump conveyor when the conveyor and the lump conveyor catch or release the medium; and wherein the accumulation mechanism includes:

an impeller that slaps down an end of the medium sent from the separation mechanism to the accumulation mechanism, a second guide member that guides the medium sent from the separation mechanism to the accumulation mechanism between the conveyor and the first guide member, and a sensor that senses the medium sent into the accumulation mechanism from the conveyance channel, the separation mechanism including a pickup roller that feeds the medium accumulated on the accumulation mechanism in a direction of the conveyance channel, a separating gate that separates the media fed by the pickup roller to send the media to the conveyance section, a third guide member that guides the medium sent from the separating gate to the conveyance channel, and a pressing plate that presses the media accumulated on the accumulation mechanism toward the pickup roller.

16. A media processor, comprising:

a conveyance channel over which a paper sheet-like medium is conveyed; and at least one accumulation mechanism that accumulates the medium sent from the conveyance channel, the accumulation mechanism including a first guide member that guides the sent medium so as to accumulate the sent medium thereon, and a conveyor that is disposed adjacent to the first guide member so as to convey the sent medium onto the first guide member, the sent medium being caught between the conveyor and the first guide member;

wherein the first guide member is disposed on both sides of the conveyor;

the media processor further comprising:

at least one separation mechanism connected to the conveyance channel for separating the media accumulated on the accumulation mechanism to send the media in series to the conveyance channel;

a conveyor driving machine that moves the conveyor to a predetermined position so as to ensure a movement separation of the media when the media are separated by the separation mechanism; and a storage in which the medium accumulated on the accumulation mechanism is stored in position;

wherein the separation mechanism and the accumulation mechanism are included in the storage, the accumulation mechanism being connected to the separation mechanism;

the media processor further comprising a guide member driving machine that moves the first guide member;

wherein in the storage, the first guide member is arranged outside on opposite sides of the conveyor;

wherein the guide member driving machine lifts the first guide member when the medium accumulated on the first guide members is stored in position; and wherein the accumulation mechanism includes an impeller that slaps down an end of the medium sent from the separation mechanism to the accumulation mechanism, a second guide member that guides the medium sent from the separation mechanism to the accumulation mechanism between the conveyor and the first guide member, and a sensor for sensing that the medium is sent from the conveyance channel into the accumulation mechanism, the separation mechanism including a pressing plate having a surface on which the medium is stored, a pickup roller that feeds out the medium accumulated on the accumulation mechanism in a direction of the conveyance channel, a separating gate that separates the medium fed by the pickup roller and sends the medium to the conveyance section, and a third guide member that guides the medium sent from the separating gate to the conveyance channel, the media processor, further comprising a pressing plate driving machine that moves to press the stored medium toward the pickup roller.

17. A media processor, comprising:

a conveyance channel over which a paper sheet-like medium is conveyed; and at least one accumulation mechanism that accumulates the medium sent from the conveyance channel, the accumulation mechanism including a first guide member that guides the sent medium so as to accumulate the sent medium thereon, and a conveyor that is disposed adjacent to the first guide member so as to convey the sent medium onto the first guide member, the sent medium being caught between the conveyor and the first guide member;

wherein the first guide member is disposed on both sides of the conveyor;

the media processor further comprising:

at least one separation mechanism connected to the conveyance channel for separating the media accumulated on the accumulation mechanism to send the media in series to the conveyance channel;

a conveyor driving machine that moves the conveyor to a predetermined position so as to ensure a movement separation of the media when the media are separated by the separation mechanism;

a storage in which the medium accumulated on the accumulation mechanism is stored in position; and a feeder/retriever that feeds the medium for supplementary to the storage and stores the medium retrieved from the storage;

wherein the separation mechanism and the accumulation mechanism are included in the feeder/retriever, the accumulation mechanism being connected to the separation mechanism;

the media processor further comprising a guide member driving machine that moves the first guide member;

wherein in the feeder/retriever, the first guide member is arranged outside on opposite sides of the conveyor;

wherein the guide member driving machine lifts the first guide member when the medium accumulated on the first guide member is stored in position; and wherein the accumulation mechanism included in the feeder/retriever includes an impeller that slaps down one end of the medium sent from the separation mechanism to the accumulation mechanism, a second guide member that guides the medium sent from the separation mechanism to the accumulation mechanism between the conveyor and the first guide member, and a sensor for sensing that the medium is sent from the conveyance channel into the accumulation mechanism, the accumulation mechanism included in the feeder/retriever including a pressing plate having a surface on which the medium is stored, a pickup roller that feeds out the medium accumulated on the accumulation mechanism in a direction of the conveyance channel, a separating gate that separates the media fed by the pickup roller and sends the medium to the conveyance section, and a third guide member that guides the medium sent from the separating gate to the conveyance channel, the media processor, further comprising a pressing plate driving machine that moves to press the medium stored in the feeder/retriever toward the pickup roller.

* * * * *